US008428476B2

(12) United States Patent
Matsuda et al.

(10) Patent No.: US 8,428,476 B2
(45) Date of Patent: Apr. 23, 2013

(54) IMAGE FORMING APPARATUS FOR DETECTING SPEED FLUCTUATION

(75) Inventors: Hiromichi Matsuda, Kanagawa (JP); Takuro Kamiya, Kanagawa (JP); Michihito Ohashi, Kanagawa (JP); Yuichi Hirose, Kanagawa (JP); Noritaka Masuda, Ibaraki (JP); Satoru Tao, Ibaraki (JP); Hiroki Tsubouchi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 888 days.

(21) Appl. No.: 12/457,747

(22) Filed: Jun. 19, 2009

(65) Prior Publication Data

US 2009/0324262 A1 Dec. 31, 2009

(30) Foreign Application Priority Data

Jun. 30, 2008 (JP) ..... 2008-171030

(51) Int. Cl.
*G03G 15/00* (2006.01)

(52) U.S. Cl.
USPC ..... 399/36; 399/167

(58) Field of Classification Search ..... 399/167
See application file for complete search history.

(56) References Cited

U.S. PATENT DOCUMENTS

| | | | | |
|---|---|---|---|---|
| 6,933,696 | B2 | 8/2005 | Ueda et al. | |
| 6,949,896 | B2 | 9/2005 | Andoh et al. | |
| 7,343,119 | B2 | 3/2008 | Matsuda et al. | |
| 7,376,375 | B2 | 5/2008 | Kobayashi et al. | |
| 7,386,262 | B2 | 6/2008 | Okamura et al. | |
| 2006/0088338 | A1 | 4/2006 | Matsuda et al. | |
| 2006/0165442 | A1 | 7/2006 | Kobayashi et al. | |
| 2006/0182471 | A1 | 8/2006 | Okamura et al. | |
| 2006/0275056 | A1 | 12/2006 | Matsuda et al. | |
| 2007/0172257 | A1 | 7/2007 | Matsuda et al. | |
| 2008/0013972 | A1 | 1/2008 | Matsuda | |
| 2008/0107449 | A1 * | 5/2008 | Oohara | 399/167 |
| 2008/0159784 | A1 * | 7/2008 | Seto | 399/167 |

(Continued)

FOREIGN PATENT DOCUMENTS

| | | |
|---|---|---|
| JP | 63-075759 | 4/1988 |
| JP | 6-327278 | 11/1994 |

(Continued)

OTHER PUBLICATIONS

Abstract of JP 05-252774 published Sep. 28, 1993.

(Continued)

*Primary Examiner* — Walter L Lindsay, Jr.
*Assistant Examiner* — Milton Gonzalez
(74) *Attorney, Agent, or Firm* — Harness, Dickey & Pierce P.L.C.

(57) ABSTRACT

An image forming apparatus is disclosed that includes an image carrier, a driving source, a rotation detection unit, and a control unit that performs fluctuation pattern recognition processing, control pattern construction processing, speed fine-adjustment processing, and remaining pattern recognition processing. The control unit is configured to perform control pattern correction processing for setting a frequency band of a remaining speed fluctuation to be detected by the remaining pattern recognition processing narrower than a frequency band of a speed fluctuation to be detected by the fluctuation pattern recognition processing and correcting the speed control pattern so as to be a pattern capable of reducing even the remaining speed fluctuation based on a remaining speed fluctuation pattern recognized by the remaining pattern recognition processing.

8 Claims, 11 Drawing Sheets

U.S. PATENT DOCUMENTS

| | | | | |
|---|---|---|---|---|
| 2008/0170884 | A1 | 7/2008 | Matsuda | |
| 2009/0026689 | A1 | 1/2009 | Noguchi et al. | |
| 2009/0263158 | A1* | 10/2009 | Murata et al. | 399/167 |

FOREIGN PATENT DOCUMENTS

| | | |
|---|---|---|
| JP | 07-129034 | 5/1995 |
| JP | 09-182488 | 7/1997 |
| JP | 2000-050662 | 2/2000 |
| JP | 2001-136774 | 5/2001 |
| JP | 3196302 | 6/2001 |
| JP | 2003-186368 | 7/2003 |
| JP | 2004-045862 | 2/2004 |
| JP | 2005-77681 | 3/2005 |
| JP | 2005-80378 | 3/2005 |
| JP | 2007-065069 | 3/2007 |
| JP | 2007-232986 | 9/2007 |

OTHER PUBLICATIONS

Japanese Office Action dated Sep. 7, 2012, issued in Japanese Patent Application No. 2008-171030.

* cited by examiner

IMAGE FORMING APPARATUS FOR DETECTING SPEED FLUCTUATION

BACKGROUND OF THE INVENTION

1. Field of the Invention

The present invention relates to an image forming apparatus such as a copier, a facsimile machine, and a printer that performs the process of transferring a visible image on the peripheral surface of an image carrier to a transfer body or the process of transferring a visible image on another image carrier to the peripheral surface of the image carrier, while driving and rotating the image carrier such as a photosensitive body and an intermediate transfer body with a driving source.

2. Description of the Related Art

The image forming apparatus of this type transfers a visible image on the peripheral surface of an image carrier to a transfer body or a visible image on the peripheral surface of another image carrier to the peripheral surface of the image carrier, while rotating and driving the image carrier such as a photosensitive body and an intermediate transfer body. A rotational driving force is transmitted to the image carrier through members of a driving transmission system such as a driving reception gear that rotates together with the image carrier and a motor gear on a driving side. If these members of the driving transmission system are off-centered or slightly contorted, a cyclic speed fluctuation occurs in the image carrier that is rotated and driven. For example, if the driving reception gear that rotates together with the image carrier is off-centered, the following cyclic speed fluctuation occurs. In other words, when the maximum diameter part of the driving reception gear, at which a length from a rotary shaft to a gear tooth tip is the longest with respect to the off-centering of the driving reception gear, is engaged with the motor gear on the driving side, the linear speed of the image carrier per rotation becomes the slowest. Conversely, when the minimum diameter part of the driving reception gear, at which the distance from the rotary shaft to the gear tooth tip is the shortest with respect to the off-centering of the driving reception gear, is engaged with the motor gear on the driving side, the linear speed of the image carrier per rotation becomes the fastest. Since the maximum diameter part and the minimum diameter part of the driving reception gear are symmetrical about a point by 180° relative to the rotary shaft, the linear speed of the image carrier is caused to have a fluctuation characteristic in which a sine curve for one cycle is displayed per cycle of the gear.

If the cyclic speed fluctuation occurs in the image carrier in the process of transferring a visible image, streaky density irregularity is caused in the transferred visible image. This streaky density irregularity is caused when dot pitches in the visible image become uneven in accordance with the cyclic speed fluctuation of the image carrier. In the so-called tandem-type image forming apparatus in which different colors of visible images formed on plural image carriers are transferred to the transfer body one on another to obtain a multicolor image, image quality is greatly degraded due to the unevenness of the dot pitches. This is because slight overlap misalignment between the respective colors of the dots due to the unevenness of the dot pitches of the respective colors of the visible images is easily visually-recognized as a color shift.

An image forming apparatus described in Patent Document 1 performs feedforward control of the driving speed of a driving motor that drives the image carrier to prevent such a color shift. Specifically, this image forming apparatus starts a dedicated mode (hereinafter referred to as a control data construction mode) for constructing a speed control pattern used for the feedforward control of the driving motor immediately after the power of the apparatus is turned on. First, in the control data construction mode, a cyclic speed fluctuation pattern per rotation of the image carrier is recognized based on an output from a rotary encoder provided in the rotary shaft of the image carrier, while the driving motor is driven at a constant speed. Then, the speed control pattern of the driving motor that could resolve the cyclic speed fluctuation of the image carrier is constructed based on the pattern. After that, when the image forming apparatus performs a print job upon receiving printing instructions from a user, it finely adjusts the driving speed of the driving motor based on the speed control pattern constructed in the control data construction mode, thereby making it possible to rotate and drive the image carrier at a steady speed. Thus, the image forming apparatus can prevent the color shift by reducing the speed fluctuation of the image carrier in the transfer process.

However, if the speed fluctuation pattern detected in the control data construction mode is then greatly changed for any reason, the speed control pattern used for the feedforward control becomes unsuitable. Actually, the present inventors have found from an experiment that although reasons and emergence amounts are different depending on the configuration of the apparatus, the speed fluctuation pattern is greatly changed from that when the power is turned on if printing is continuously performed many times. The color shift due to an inappropriate speed control pattern can be prevented provided that the control data construction mode is started on a regular basis to properly update the speed control pattern even after the power is turned on. In this case, however, since the image forming apparatus cannot receive printing instructions from the user during the control data construction mode in which the driving motor is driven at a constant speed, downtime of the apparatus is caused to increase.

On the other hand, Patent Document 2 describes an image forming apparatus that updates the speed control pattern every rotation of the image carrier during the print job based on the detected result of the remaining speed fluctuation of the image carrier. This image forming apparatus detects the remaining speed fluctuation of the image carrier remaining even after performing the feedforward control of the driving speed of the driving motor in accordance with the speed control pattern based on an output from the rotary encoder. Then, the image forming apparatus performs the process of constructing a new speed control pattern that could reduce even a detected remaining speed fluctuation every rotation of the image carrier. With this configuration, the image forming apparatus can prevent the degradation of the color shift due to an inappropriate speed control pattern without increasing the downtime of the apparatus.

Patent Document 1: JP-A-9-182488

Patent Document 2: JP-A-2003-186368

However, this image forming apparatus requires a control unit more expensive than that of the image forming apparatus described in Patent Document 1. Specifically, the cyclic speed fluctuation occurring in the image carrier is not limited to the first-order fluctuation component that emerges at a rate of one cycle per rotation of the image carrier. For example, a second-order fluctuation component that emerges at a rate of two cycles and a third-order fluctuation component also occur. In addition, a high-order (e.g., several-tens-order) fluctuation component due to the rotation of a small diameter gear such as a motor gear also occurs. Moreover, an ultra-high-order fluctuation component more than the 100th order due to the engagement of the gears also occurs. To accurately reduce the speed fluctuation, it is necessary to accurately detect the low-order and high-order fluctuation components in addition to the elimination of the ultra-high-order fluctuation component. The image forming apparatus described in Patent Document 1, which starts the dedicated control data construction mode at times other than the print job to detect the speed fluctuation, does not cause a heavy arithmetic load even if it detects the high-order fluctuation component. On the other hand, the image forming apparatus described in Patent Document 2, which detects the remaining speed fluctuation while performing the print job, causes a heavy arithmetic load because both processing for detecting the high-order fluctuation component and processing for performing the print job are performed.

SUMMARY OF THE INVENTION

The present invention has been made in light of the above circumstances and may provide an image forming apparatus capable of preventing the degradation of a color shift due to an inappropriate speed control pattern and reducing an arithmetic load on a control unit without increasing the downtime of the apparatus.

According to an embodiment of the present invention, there is provided an image forming apparatus. The image forming apparatus includes an image carrier that has a visible image carried on its rotating peripheral surface; a driving source that generates a driving force for rotating and driving the image carrier; a rotation detection unit that detects a rotational angle speed or a rotational angle displacement of the image carrier; and a control unit that performs fluctuation pattern recognition processing for detecting a speed fluctuation of the image carrier based on an output from the rotation detection unit while driving the driving source in a state in which a print job in accordance with a user's instruction is not performed, thereby recognizing a speed fluctuation pattern per integer rotation of the image carrier, control pattern construction processing for constructing a speed control pattern of the driving source that reduces a cyclic speed fluctuation of the image carrier based on the speed fluctuation pattern, speed fine-adjustment processing for finely adjusting a driving speed of the driving source in accordance with the speed control pattern during a transfer process including at least a process for transferring the visible image on the peripheral surface of the image carrier to a transfer body or a process for transferring a visible image on another image carrier to the peripheral surface of the image carrier, and remaining pattern recognition processing for detecting a remaining speed fluctuation remaining in the image carrier even after the speed fine-adjustment processing is performed, thereby recognizing a remaining speed fluctuation pattern per integer rotation of the image carrier. The control unit is configured to perform control pattern correction processing for setting a frequency band of the remaining speed fluctuation to be detected by the remaining pattern recognition processing narrower than a frequency band of the speed fluctuation to be detected by the fluctuation pattern recognition processing and correcting the speed control pattern so as to be a pattern capable of reducing even the remaining speed fluctuation based on the remaining speed fluctuation pattern recognized by the remaining pattern recognition processing.

Other objects, features and advantages of the present invention will become more apparent from the following detailed description when read in conjunction with the accompanying drawings.

BRIEF DESCRIPTION OF THE DRAWINGS

FIG. 8 is a graph showing the remaining speed fluctuation in the first print job after the power is turned on;

DETAILED DESCRIPTION OF THE PREFERRED EMBODIMENTS

Hereinafter, a description is made of an embodiment of a copier that forms an image with an electrophotographic system as an image forming apparatus to which the present invention is applied.

Figure 1:
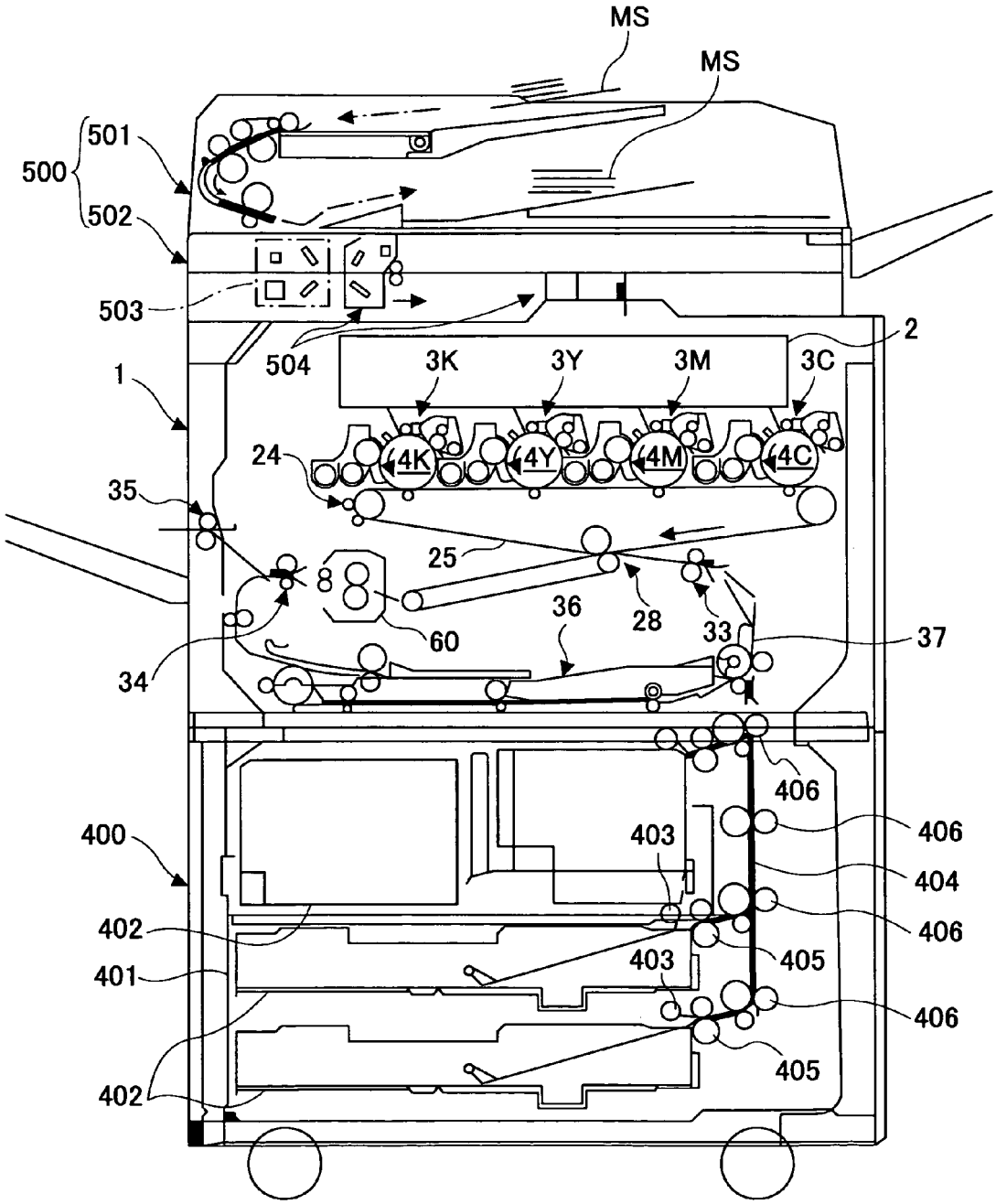
FIG. 1 is a schematic configuration diagram showing a copier according to an embodiment.

First, the basic configuration of the copier according to the embodiment is described. FIG. 1 is a schematic configuration diagram showing the copier according to the embodiment. This copier has a printer unit 1, a plain white-paper feeding unit 400, and a document conveying and scanning unit 500. The document conveying and scanning unit 500 has a scanner 502 as a document scanning unit fixed on the printer unit 1 and an ADF (Automatic Document Feeder) as a document conveying unit supported by the scanner 502.

The plain white-paper feeding unit 400 has two multistage paper-feeding cassettes 402 provided in a paper bank 401, a paper feeding roller 403 that feeds recording paper from the paper-feeding cassettes 402, a separation roller 405 that separates fed recording paper and feeds them to a paper feeding path 404, and the like. In addition, the plain white-paper feeding unit 400 has plural conveyance rollers 406 with which the recording paper is conveyed to a paper feeding path 37 in the printer unit 1, and the like. With these components, the recording paper in the paper feeding cassettes 402 is fed to the paper feeding path 37 in the printer unit 1.

Figure 2:
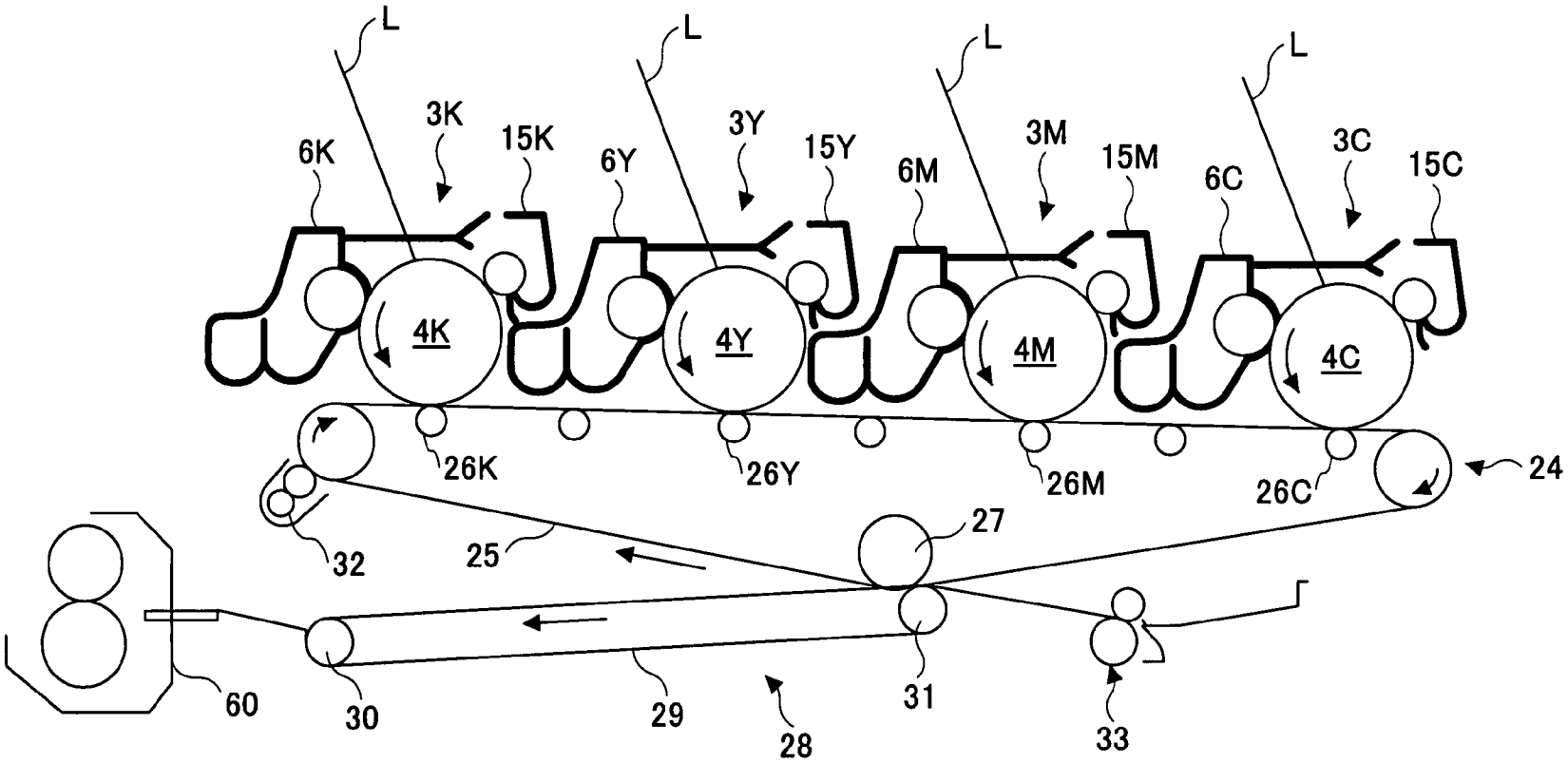
FIG. 2 is a partially-enlarged configuration diagram showing a part of the internal structure of a printer unit in the copier.

FIG. 2 is a partially-enlarged configuration diagram showing a part of the internal structure of the printer unit 1. The printer unit 1 has four processing units 3K, 3Y, 3M, and 3C that form a toner image in black, yellow, magenta, and cyan, respectively, a transfer unit 24, a paper conveyance unit 28, a pair of resist rollers 33, a fixation unit 60, and the like. Additionally, the printer unit 1 has an optical writing unit 2, a curl elimination roller group 34, a pair of paper discharging rollers 35, a switchback unit 36, a paper feeding path 37, and the like as shown in FIG. 1. Then, the printer unit 1 drives light sources such as laser diodes and LEDs not shown provided in the optical writing unit 2 to irradiate four drum-like photosensitive bodies 4K, 4Y, 4M, and 4C with laser beams L. Accordingly, electrostatic latent images are formed on the front surfaces of the photosensitive bodies 4K, 4Y, 4M, and 4C. The latent images are developed into toner images through a predetermined development process. Note that in the description, the characters K, Y, M, and C added after the numerals are specifications for representing the colors of black, yellow, magenta, and cyan, respectively.

As shown in FIG. 2, each of the processing units 3K, 3Y, 3M, and 3C has the photosensitive body serving as a latent image carrier and various units provided around the photosensitive body, which are supported by a common supporting body as a single unit and detachable from the printer unit 1. For example, the processing unit 3K for black has the photosensitive body 4K and the development unit 6K for developing an electrostatic latent image formed on the front surface of the photosensitive body 4K to a black toner image. Additionally, the processing unit 3K has a drum cleaning unit 15 that cleans transfer toner remaining at the front surface of the photosensitive body 4K after the photosensitive body 4K passes through a primary transfer nip for black described below, and the like. The copier of the embodiment has the so-called tandem type configuration in which the four processing units 3K, 3Y, 3M, and 3C are provided side by side in such a manner as to face each other along the movement direction of an intermediate transfer belt 25 described below.

Figure 3:
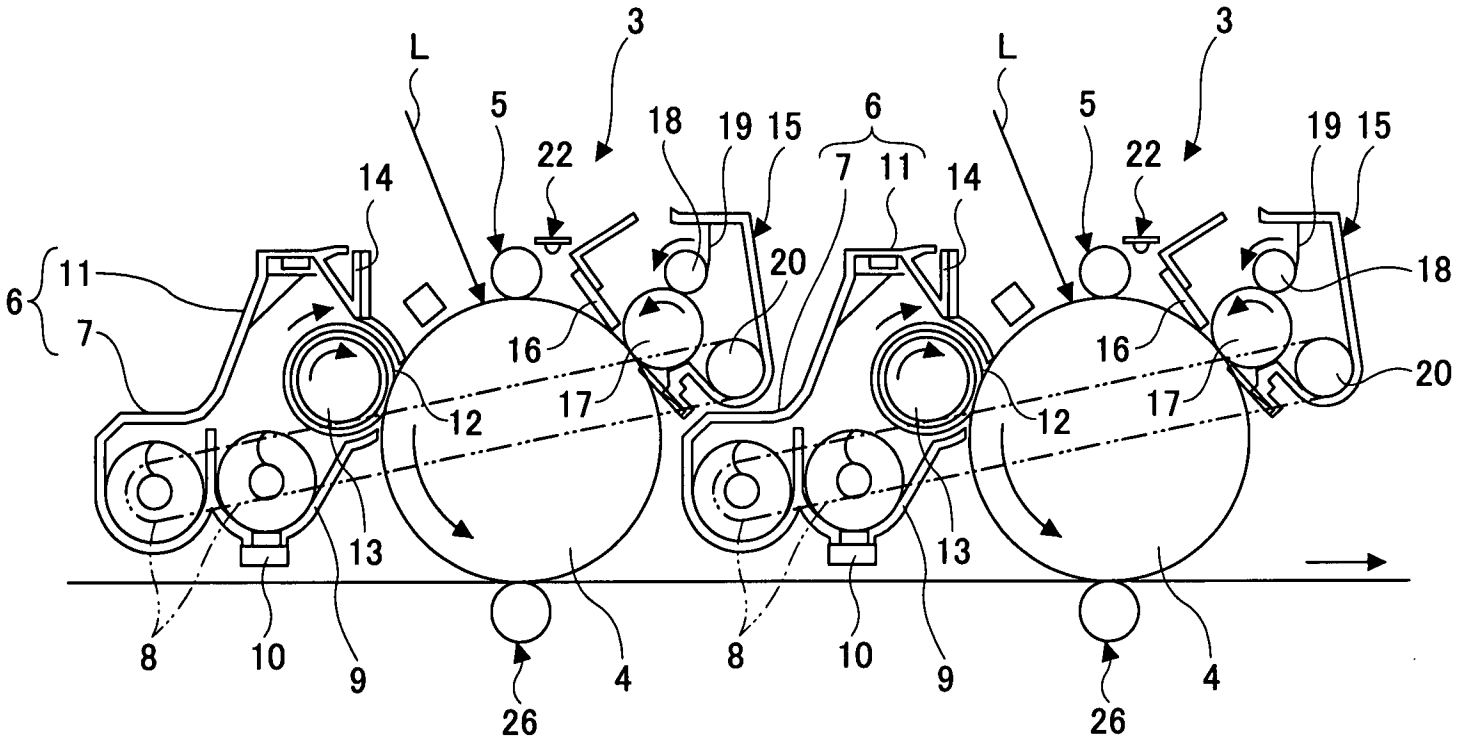
FIG. 3 is a partially-enlarged diagram showing a part of a tandem unit in the printer unit.

FIG. 3 is a partially-enlarged diagram showing a part of a tandem unit composed of the four processing units 3K, 3Y, 3M, and 3C. Note that since the four processing units 3K, 3Y, 3M, and 3C have almost the same configuration except that they use different colors of toner, the characters K, Y, M, and C added after the numerals are omitted in FIG. 3. As shown in FIG. 3, the processing unit 3 has a charging unit 5, a development unit 6, a drum cleaning unit 15, an electrostatic elimination lamp 22, and the like around the photosensitive body 4.

The photosensitive body 4 is a drum-like pipe stock made, for example, of aluminum on which an organic photosensitive material having photosensitivity is coated to form a photosensitive layer. Alternatively, an endless belt-like photosensitive body may be used.

The development unit 6 develops a latent image by using a two-component developing agent containing a magnetic carrier and nonmagnetic toner not shown. The development unit 6 has a stirring unit 7 that stirs the two-component developing agent accommodated in the stirring unit 7 and conveys it to a development sleeve 12 and a development unit 11 that transfers toner in the two-component developing agent carried on the development sleeve 12 to the photosensitive body 4. Note that the development unit 6 may be of a type that develops a latent image by using a one-component developing agent not containing the magnetic carrier instead of the two-component developing agent.

The stirring unit 7 is provided at a position lower than the development unit 11 and has two conveyance screws 8 provided in parallel to each other, a partition plate provided between the screws 8, a toner density sensor 10 provided at the bottom surface of a development case 9, and the like.

The development unit 11 has the development sleeve 12 that faces the photosensitive body 4 through the opening of the development case 9, a magnetic roller 13 provided inside the development unit 11 so as not to be rotatable, a doctor blade 14 whose tip end comes close to the development sleeve 12, and the like. The development sleeve 12 is a nonmagnetic rotatable cylinder. The magnetic roller 13 has plural magnetic poles successively arranged side by side in the rotating direction of the development sleeve 12 from a position at which the magnetic roller 13 faces the doctor blade 14. Each of the magnetic poles applies a magnetic force on the two-component developing agent on the development sleeve 12 at a predetermined position in the rotating direction. Thus, the two-component developing agent fed from the stirring unit 7 is attracted and carried on the front surface of the development sleeve 12, which in turn forms a magnetic brush along a magnetic line on the front surface of the development sleeve 12.

The magnetic brush is regulated so as to have an appropriate layer thickness when passing through the position at which the magnetic roller 13 faces the doctor blade 14 along with the rotation of the development sleeve 12 and conveyed to a development region at which the development sleeve 12 faces the photosensitive body 4. Then, with a potential difference between a development bias applied to the development sleeve 12 and an electrostatic latent image on the photosensitive body 4, toner is transferred to the electrostatic latent image to contribute to the development. After that, the toner is returned to the development unit 11 again along with the rotation of the development sleeve 12, separated from the front surface of the development sleeve 12 due to the influence of a repulsive magnetic field formed between the magnetic poles of the magnetic roller 13, and returned to the stirring unit 7. In the stirring unit 7, an appropriate amount of the toner is replenished to the double-component developing agent based on a detection result by the toner density sensor 10.

The drum cleaning unit 15 is of a type in which a cleaning blade made of a polyurethane rubber is pressed against the photosensitive body 4, but other types of drum cleaning units may be used. In this example, in order to improve a cleaning property, the drum cleaning unit 15 has a fur brush 17 having contact conductivity so as to be rotatable in the direction as indicated by an arrow in FIG. 3 so that its front surface is brought into contact with the photosensitive body 4. The fur brush 17 also scrapes a lubricant agent from a solid lubricant agent not shown, reduces it to fine powder, and coats the fine powder on the front surface of the photosensitive body 4. A metal electric-field roller 18 that applies a bias to the fur brush 17 is provided so as to be rotatable in the direction as indicated by an arrow. The tip end of a scraper 19 is brought into contact with the metal electric-field roller 18. The toner attached to the fur brush 17 is transferred to the electric-field roller 18 that contacts the fur brush 17 in a counter direction and applies the bias to the fur brush 17 while rotating. Then, the toner is scraped from the electric-field roller 18 by the scraper 19 and dropped onto a collection screw 20. The collection screw 20 conveys the collected toner to an end part in the drum cleaning unit 15 in the direction orthogonal to the paper sheet of FIG. 3 and passes it to an external recycle conveyance unit 21. The recycle conveyance unit 21 conveys the received toner to the development unit 6 for recycling.

An electrostatic elimination lamp 22 eliminates electrostatic charge from the photosensitive drum 4 by light irradiation. The front surface of the photosensitive body 4 from which electrostatic charge has been eliminated is uniformly charged by the charging unit 5 and is subjected to optical writing processing by the optical writing unit 2. Note that the charging unit 5 is of a type in which a charging roller that applies a charging bias is rotated while being brought into contact with the photosensitive body 4. Alternatively, a scorotron charger that performs charging processing on the photosensitive body 4 in a noncontact manner, and the like may be used.

In the photosensitive bodies 4K, 4Y, 4M, and 4C of the four processing units 3K, 3Y, 3M, and 3C shown in FIG. 2, toner images in black, yellow, magenta, and cyan are formed, respectively, in the processes described above.

The transfer unit 24 is provided below the four processing units 3K, 3Y, 3M, and 3C. In the transfer unit 24, the intermediate transfer belt 25 stretched by plural rollers is endlessly moved in the clockwise direction in FIG. 2 while being brought into contact with the photosensitive bodies 4K, 4Y, 4M, and 4C. Thus, primary transfer nips for black, yellow, magenta, and cyan are formed in which the photosensitive bodies 4K, 4Y, 4M, and 4C are brought into contact with the intermediate transfer belt 25. In the vicinity of the primary transfer nips for black, yellow, magenta, and cyan, the intermediate transfer belt 25 is pressed against the photosensitive bodies 4K, 4Y, 4M, and 4C by primary transfer rollers 26K, 26Y, 26M, and 26C provided inside a belt loop. A primary transfer bias is applied to the primary transfer rollers 26K, 26Y, 26M, and 26C by a power supply not shown. Thus, in the primary transfer nips for black, yellow, magenta, and cyan, primary transfer electric-fields are formed that cause the toner images on the photosensitive bodies 4K, 4Y, 4M, and 4C to electrostatically move to the intermediate transfer belt 25. At the front surface of the intermediate transfer belt 25 that successively passes through the primary transfer nips for black, yellow, magenta, and cyan along with the endless-movement of the intermediate transfer belt 25 in the clockwise direction in FIG. 2, the toner images are successively superimposed one on another by the respective primary transfer nips and primarily transferred. Through this superimposed primary transfer, a four-color superimposed toner image (hereinafter referred to as a four-color toner image) is formed on the front surface of the intermediate transfer belt 25.

In FIG. 2, a paper conveyance unit 28 is provided below the transfer unit 24 in which an endless paper conveyance belt 29 is stretched and endlessly moved between a driving roller 30 and a secondary transfer roller 31. The intermediate transfer belt 25 and the paper conveyance belt 29 are held between the secondary transfer roller 31 and the lower stretch roller 27 of the transfer unit 24. Thus, a secondary transfer nip is formed in which the front surface of the intermediate transfer belt 25 is brought into contact with the front surface of the paper conveyance belt 29. A secondary transfer bias is applied to the secondary transfer roller 31 by the power supply not shown. On the other hand, the lower stretch roller 27 of the transfer unit 24 is grounded. Thus, a secondary transfer electric-field is formed in the secondary transfer nip.

On the right side of the secondary transfer nip in FIG. 2, the pair of resist rollers 33 is provided. The recording paper held between the pair of rollers 33 is fed to the secondary transfer nip at timing capable of being synchronized with the four-color toner image on the intermediate transfer belt 25. In the secondary transfer nip, the four-color toner image on the intermediate transfer belt 25 is secondarily transferred to the recording paper in a collective manner due to the secondary transfer electric-field and a nip pressure, thereby forming a full-color image in cooperation with white color of the recording paper. The recording paper that has passed through the secondary transfer nip is separated from the intermediate transfer belt 25 and conveyed to the fixation unit 60 along with the endless movement of the paper conveyance belt 29 while being supported by the front surface of the paper conveyance belt 29.

At the front surface of the intermediate transfer belt 25 that has passed through the secondary transfer nip, remaining transfer toner that has not been transferred to the recording paper by the secondary transfer nip is attached. This remaining transfer toner is scraped and eliminated by a belt cleaning unit 32 that comes into contact with the intermediate transfer belt 25.

After the full-color image on the recording paper conveyed to the fixation unit 60 is fixed by pressure and heating of the fixation unit 60, the recording paper is fed from the fixation unit 60. The recording paper passes through a nip formed by the curl elimination roller group 34 shown in FIG. 1 and a nip formed by the pair of paper discharging rollers 35 and is then discharged to the outside of the apparatus.

The switchback unit 36 is provided below the paper conveyance unit 28 and the fixation unit 60. Accordingly, the movement direction of the recording paper having undergone the image fixation processing for its one surface is switched to the side of a recording paper inversion unit. The recording paper is thus inverted, and then it enters the secondary transfer nip again. After having undergone the secondary transfer processing and the fixation processing on the other surface, the recording paper is discharged onto a paper receiving tray.

The scanner 502 fixed onto the printer unit 1 has a fixed scanning unit 503 and a moving scanning unit 504 serving as scanning units for scanning an image on a document MS. The fixed scanning unit 503 having a light source, reflection mirrors, and an image scanning sensor such as a CCD is provided right below a first contact glass not shown fixed on the top wall of the case of the scanner 502 so as to contact the document MS. In the fixed scanning unit 503, light emitted from the light source is successively reflected by the surface of the document and received by the image scanning sensor through the reflection mirrors when the document MS fed from the ADF 501 passes through the first contact glass. Thus, the fixed scanning unit 503 scans the document MS without moving the optical system composed of the light source, the reflection mirrors, and the like.

On the other hand, the moving scanning unit 504 is provided right below a second contact glass not shown fixed on the top wall of the case of the scanner 502 so as to contact the document MS and on the right side of the fixed scanning unit 503 in FIG. 1, and it can move the optical system composed of the light source, the reflection mirrors, and the like to right and left directions in FIG. 1. In a process in which the optical system is moved from the left side to the right side in FIG. 1, light emitted from the light source is reflected by a document not shown placed on the second contact glass and received by the image scanning sensor fixed onto a scanner main body through the plural reflection mirrors. Thus, the moving scanning unit 504 scans the document while moving the optical system.

In the printer unit 1, a conveyance path for conveying a recording paper P serving as a paper-like recording member is formed. Also, in the printer unit 1, a toner image forming unit that forms a toner image on the recording paper P serving as the recording member conveyed on the conveyance path is configured by the combination of the optical writing unit 2, the four processing units 3K, 3Y, 3M, and 3C, and the transfer unit 24. The above-described paper feeding path 37 is a part of this conveyance path and serves as a pre-recording path through which the recording paper P received from the plain white-paper feeding unit 400 is conveyed up to the position right before the secondary transfer nip at which a toner image is formed on the recording paper P. The path after the secondary transfer nip serves as a post-recording path through which the recording paper P on which the toner image has been formed is conveyed. This post-recording path is a path reversely tracing the secondary transfer nip, the top stretched surface of the paper conveyance belt 29, the inside of the fixation unit 60, the nip by the curl elimination roller group 34, and the nip by the pair of paper discharging rollers 35.

Figure 4:
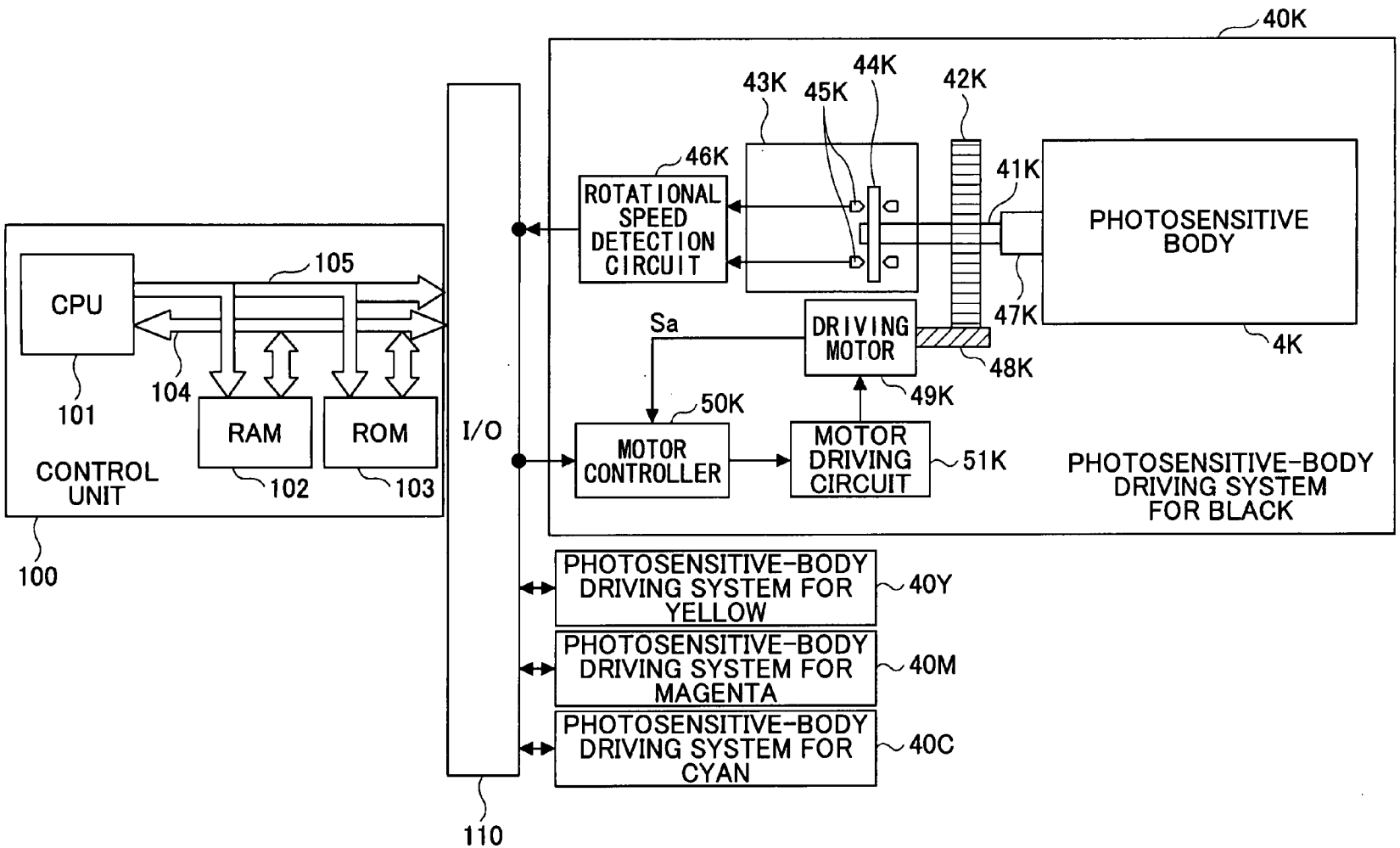
FIG. 4 is a block diagram showing a substantial part of an electric circuit of the copier.

FIG. 4 is a block diagram showing a substantial part of the electric circuit of the copier according to the embodiment. In FIG. 4, a control unit 100 controls the whole printer unit 1 shown in FIG. 1 and has a CPU (Control Processing Unit) 101 serving as a calculation unit, a RAM (Random Access Memory) 102 serving as an information storage unit, a ROM (Read Only Memory) 103 serving as an information storage unit, and the like. The control unit 100 performs various processing based on a program and the like stored in the information storage units. Various equipment and sensors are connected to the control unit 100 through an I/O unit 110. In FIG. 4, among the various equipment connected to the I/O unit 110, only photosensitive-body driving systems 40K, 40Y, 40C, and 40M for black, yellow, cyan, and magenta are shown for the sake of convenience.

The photosensitive-body driving systems 40K, 40Y, 40C, and 40M for black, yellow, cyan, and magenta have the same configuration. For example, the photosensitive-body driving system 40K for black is configured as follow. In other words, a driving shaft 41K integrally rotating with a photosensitive-body rotary shaft is connected to the rotary shaft of the drum-like photosensitive body 4K rotatably supported by a supporting plate not shown so as to be aligned on the same axis line as the photosensitive body 4K through a coupling 47K. The photosensitive body 4K is separated from the main body of the copier at the position of the coupling 47K and removed from the main body of the copier as the processing unit described above. A photosensitive-body gear 42K is fixed to the driving shaft 41K remaining on the side of the main body of the copier, and a motor gear 48K of a driving motor 49K is engaged with the photosensitive-body gear 42K. When the motor gear 48K is rotated by the driving of the driving motor 49K, its rotational driving force is transmitted to the driving shaft 41K integrally rotating with the photosensitive-body gear 42K and the photosensitive body 4K through the coupling 47K. Thus, the photosensitive body 4K is rotated and driven. The driving motor 49K in the embodiment is a brushless DC motor or a stepping motor.

The reduction ratio of a reduction mechanism in a driving transmission path from the driving motor 49K to the photosensitive body 4K is properly determined based on, for example, a relationship between the target rotational speed of the photosensitive body 4K and motor characteristics. In the copier of the embodiment, the reduction ratio is set to 1:20. The reduction mechanism implementing this reduction ratio is a single-stage reduction mechanism that uses only the engagement of the motor gear 48K with the photosensitive-body gear 42K. Such a simple single-stage reduction mechanism can reduce the number of components and cyclic speed fluctuation factors of the photosensitive-body gear 42K due to the engagement of teeth and the off-centering of gears. Also, in the single-stage reduction mechanism, the photosensitive-body gear 42K is larger in diameter than the photosensitive body 4K. Therefore, the single-stage reduction mechanism can reduce influences due to printing density irregularity (banding) in a sub-scanning direction by reducing an error in a single pitch of the gear. Note that a flywheel may be fixed to the driving shaft 41K or the rotary shaft of the photosensitive body 4K to reduce an ultra-high-order speed fluctuation component due to the engagement of the teeth of the gear.

A rotary encoder 43K serving as a rotation detection unit is fixed to the driving shaft 41K, and an output from the rotary encoder 43K is input to the control unit 100 through a rotational speed detection circuit 46K and the I/O unit 110. The rotary encoder 43K in the embodiment is a known optical encoder as follows. In other words, the optical-encoder has a code wheel 44K having code marks provided at regular intervals and rotation sensors 45K that optically detect the cord code marks of the code wheel 44K on the concentric circle of a disc made of a transparent member such as a glass and plastic. The rotary encoder 43K detects the code marks on the code wheel 44K at a position at which a phase is shifted by 180° by using the two rotation sensors 45K. Therefore, even if the code wheel 44K is attached to the driving shaft 41K in an off-centered state, the detection data of the two rotation sensors 45K are averaged so that the rotational angle speed of the driving shaft 41K can be detected with high accuracy. Note that instead of the optical encoder, a magnetic encoder may be employed that detects magnetic marks provided on the concentric circle on a disc made of a magnetic body by a magnetic head. Furthermore, a known tachogenerator may be employed.

The rotational speed detection circuit 46K obtains the rotational angle speed of the driving shaft 41K based on the time interval of a detection signal output from the rotary encoder 43K and outputs it to the control unit 100.

Additionally, the photosensitive-body driving system 40K for black has a motor controller 50K, a motor driving circuit 51K, and the like. The motor controller 50K regulates a driving signal transmitted to the motor driving circuit 51K so that the average of the driving speeds of the driving motor 49K matches a target speed transmitted from the control unit 100. That is, the motor controller 50K compares a rotation signal Sa from a rotation detector not shown fixed to the motor shaft of the driving motor 49K with the target speed of feedforward control and regulates the driving signal based on a difference obtained by the comparison. The rotation detector in the embodiment may include, for example, a motor built-in type speed sensor and a printed-coil type frequency generator. As the frequency generator, an inexpensive built-in type encoder such as an MR sensor may be used.

When the DC brushless motor is employed as the driving motor 49K, the motor controller 50K may be caused to perform the following processing. In other words, the driving motor 49K is caused to compare a motor rotational speed based on the rotation signal Sa with a target speed transmitted from the control unit 100 through the I/O unit 110 and generate and output a driving signal (PWM signal) to a driving circuit so that the motor rotational speed matches the target speed of the feedforward control. Such processing can be performed by a known PLL control circuit system. That is, a pulse signal frequency-modulated in accordance with a feedforward-control numerical value transmitted from the control unit 100 is output. The PLL control circuit compares the pulse signal with the phase or frequency of the pulse signal of the rotation signal Sa to regulate a motor driving signal.

The motor driving circuit 51K synthesizes the driving signal (PWM signal) transmitted from the motor controller 50K with a phase switching signal by an AND gate, applies chopping with a driving current to the same, and outputs a driving current for controlling the rotational speed of the driving motor 49K. The driving motor 49K composed of the DC brushless motor has a three-phase (U, V, and W) star-connection coil and rotor. The driving motor 49K also has three hole elements for detecting the magnetic pole of the rotor serving as a position detection unit for the rotor, and the output terminals of the hole elements are connected to the motor driving circuit 51K. The motor driving circuit 51K specifies the position of the rotor based on a rotor position signal from the hole elements to generate the phase switching signal. This phase switching signal successively switches phases excited by controlling the on/off of transistors of the motor driving circuit 51K to rotate the rotor.

On the other hand, when the stepping motor is employed as the driving motor 49K, the motor controller 50K may be caused to perform the following processing. In other words, the motor controller 50K is caused to generate a motor clock to be output to the motor driving circuit 51K based on a driving control value indicating a target speed transmitted from the control unit 100 through the I/O unit 110. Then, the motor controller 50K causes the motor driving circuit 51K to output a driving current corresponding to the motor clock to the driving motor 49K. At this time, while detecting the rotation signal Sa from the stepping motor, the motor controller 50K determines whether the motor may cause a loss of synchronism due to requests for an excessive driving load and excessive acceleration. If the motor may cause the loss of synchronism, the motor controller 50K regulates the frequency of the motor clock to avoid causing the loss of synchronism. If the motor clock of the frequency corresponding to the driving control value can be output as it is without the necessity of avoiding the loss of synchronism, the motor clock may be transmitted from the control unit 100 instead of using the motor controller 50K. This is because the stepping motor has the characteristic of rotating so as to follow the motor clock.

The rotational speed detection circuit 46K performs processing for calculating the rotational speeds of the driving shaft 41K based on the output signals from the two rotation sensors 45K of the rotary encoder 43K, averaging the calculated results, and temporarily storing the averaged value in a storage circuit not shown at a predetermined cycle. The data thus temporarily stored are loaded into the CPU 101 and the RAM 102 through the I/O unit 110 and a data bus 104 and used by the CPU 101 as data for constructing a speed control pattern for the feedforward control. Note that various coefficients and programs for calculating the speed control pattern are stored in the ROM 103. The control unit 100 specifies a ROM address, a RAM address, various input/output equipment, and the like by using an address bus 105.

The CPU 101 determines the rotational phase of the photosensitive body 4K based on the number of output signal pulses from the rotational speed detection circuit 46K. Upon detecting that the rotational speed of the photosensitive body 4K has reached a prescribed speed, the CPU 101 reads data corresponding to the rotational phase from the data string of the speed control pattern of the photosensitive body 4K stored in the RAM 102 in accordance with the rotational phase of the photosensitive body 4K and then outputs it to the motor controller 50K as a target speed. Note that when the number of rotations of the driving motor 49K is an integral multiple of one rotation of the photosensitive body, the CPU 101 can determine the rotational phase of the photosensitive body 4K based on the rotation signal Sa instead of the output signal pulse from the rotational speed detection circuit 46K.

In FIG. 4, only the photosensitive-body driving system 40K among the four photosensitive-body driving systems is described in detail as for the internal configuration, but the photosensitive-body driving systems 40Y, 40C, and 40M have the same configuration as that of the photosensitive-body driving system 40K.

Next, a characteristic configuration of the copier according to the embodiment is described.

By using a testing machine similar to the copier according to the embodiment, the present inventors have conducted an experiment for examining a tendency in the remaining speed fluctuation of the photosensitive body at a successive printing operation. Specifically, prior to the successive printing operation, the driving motor 49K is first driven at a constant speed to cause the photosensitive body 4K for black to rotate plural times, while the rotational speed detection circuit 46K is caused to calculate and store the rotational speed of the photosensitive body 4K for black at a predetermined cycle. The control unit 100 is caused to perform processing for constructing the speed control pattern of the driving motor 49K so as to cancel the speed fluctuation pattern after recognizing the speed fluctuation pattern per rotation of the photosensitive body 4K. Then, the successive printing operation for successively printing a monochrome test image is performed. In this case, the driving of the driving motor 49K is feedforward-controlled based on the speed control pattern constructed in advance. Subsequently, during the successive printing operation, the rotational speed by the rotational speed detection circuit 46K is calculated, and storage data are successively loaded into the RAM 102. When the successive printing operation is completed, a remaining speed fluctuation amount remaining in the photosensitive body 4K even after the feedforward control is obtained. As to this remaining speed fluctuation amount, remaining speed fluctuation components at plural frequencies are independently obtained. It is found from this that the remaining speed fluctuation amount increases along with an increase in the number of print-out sheets at certain frequencies in the remaining speed fluctuation components, but no temporal change is found in the remaining speed fluctuation amount at most frequency bands.

Figure 5:
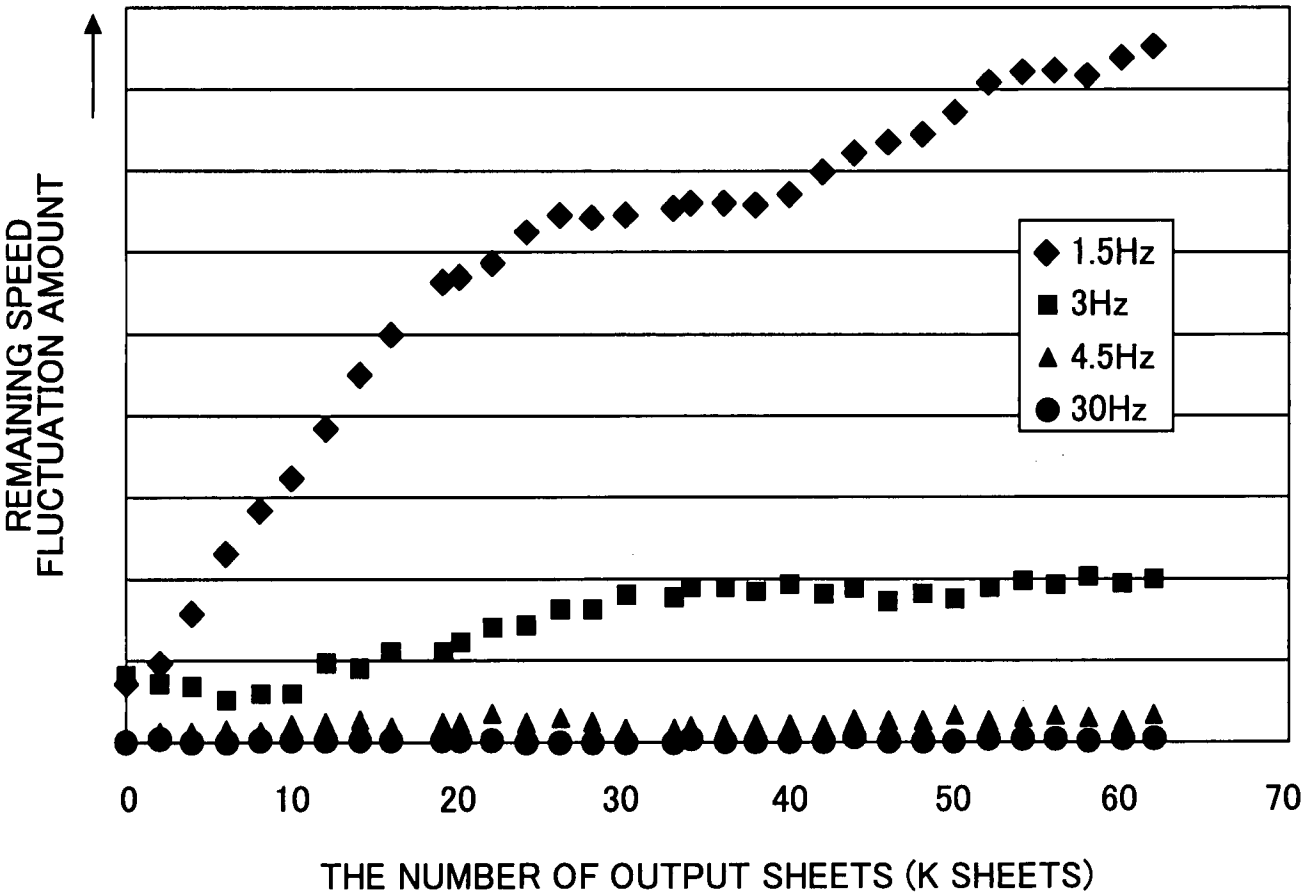
FIG. 5 is a graph showing the temporal change of a remaining speed fluctuation amount during a successive printing operation.

FIG. 5 is a graph showing the temporal changes of four types of the remaining speed fluctuations among those at various frequencies obtained by the experiment during the successive printing operation. As shown in FIG. 5, the amount of the remaining speed fluctuation occurring in a cycle of 1.5 Hz greatly increases with the elapse of the time of the successive printing operation. 1.5 Hz corresponds to the cycle of one rotation of the photosensitive body 4K. That is, the amount of the first-order remaining speed fluctuation per rotation of the photosensitive body 4K greatly increases during the successive printing operation. Furthermore, the amount of the remaining speed fluctuation occurring in a cycle of 3 Hz is greatly smaller than that of the remaining speed fluctuation occurring in the cycle of 1.5 Hz, but the amount slightly increases with the elapse of the time of the printing operation. That is, the amount of the second-order remaining speed fluctuation per rotation of the photosensitive body 4K also slightly increases during the successive printing operation although it is small. Conversely, the remaining speed fluctuations occurring in cycles of 4.5 Hz and 30 Hz hardly change even if the number of print-out sheets during the successive print operation increases. Although not shown in FIG. 5, the remaining speed fluctuations in frequency bands in the range of 5 through 30 Hz and greater than or equal to 30 Hz hardly change.

Figure 6:
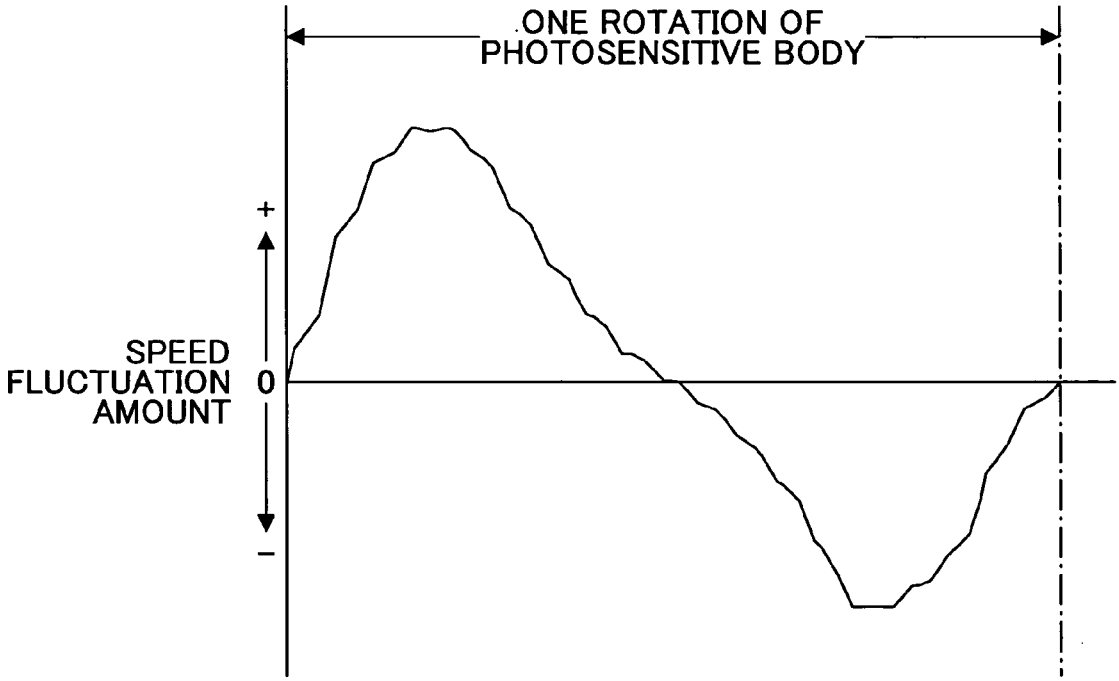
FIG. 6 is a graph showing an example of a speed fluctuation of a photosensitive body detected when a driving motor is driven at a constant speed.
Figure 7:
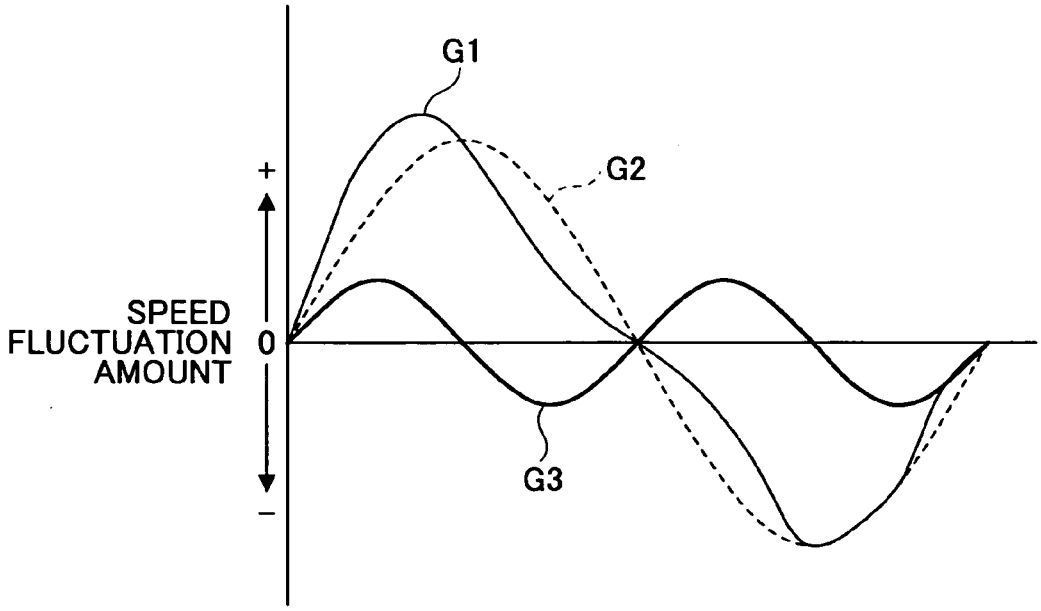
FIG. 7 is a graph showing a smoothing waveform obtained by eliminating a high-order fluctuation component from a waveform shown in FIG. 6 and the first-order and second-order component waveforms contained in the smoothing waveform.

It is found from these test results that the temporal changes in the speed fluctuation of the photosensitive body 4K appear only in the specific cycle fluctuation components. Particularly, the temporal changes are found in low-order fluctuation components such as the first-order and second-order fluctuation components at the various cycles, but they are not found in high-order speed fluctuations that cause a higher calculation load, which is so effective for reducing a calculation load on a control unit. This is because it is only necessary to detect low-order remaining fluctuations that do not require a high calculation load to correct a speed control pattern during the print job. Specifically, FIG. 6 is a graph showing an example of the speed fluctuation of the photosensitive body 4K detected when the driving motor 49K is driven at a constant speed. As shown in FIG. 6, the speed fluctuation of the photosensitive body 4K detected when the driving motor 49K is driven at a constant speed has the characteristic of displaying a sine curve for one cycle per rotation of the photosensitive body 4K as a whole. The minutely saw-toothed parts of the line in the graph represent high-order speed fluctuation components due to the off-centering of a motor gear having a small diameter. When the high-order speed fluctuation components are eliminated to facilitate understanding, the graph of the speed fluctuation becomes a smoothly-curved line as indicated by a line G1 in FIG. 7. This smoothly-curved line G1 is obtained by synthesizing the first-order fluctuation component as indicated by a line G2 with the second-order fluctuation component as indicated by a line G3 in FIG. 7. Since the first-order fluctuation component is extremely greater than the second-order fluctuation component, the synthesized wave of the both components (hereinafter referred to as a low-order fluctuation component wave) becomes the sine curve for one cycle as a whole as shown in FIG. 7. With the testing machine, the low-order fluctuation component wave changes with time during the successive printing operation, while no temporal change is found in a high-order fluctuation component wave forming the minutely saw-toothed parts in the graph of FIG. 6. Therefore, the high-order fluctuation component wave is detected only once together with the low-order fluctuation component wave, for example, when the power is turned on. Thus, it is only necessary to detect the low-order fluctuation component wave remaining in the feed-forward and correct the speed control pattern based on the detected result.

Figure 8:
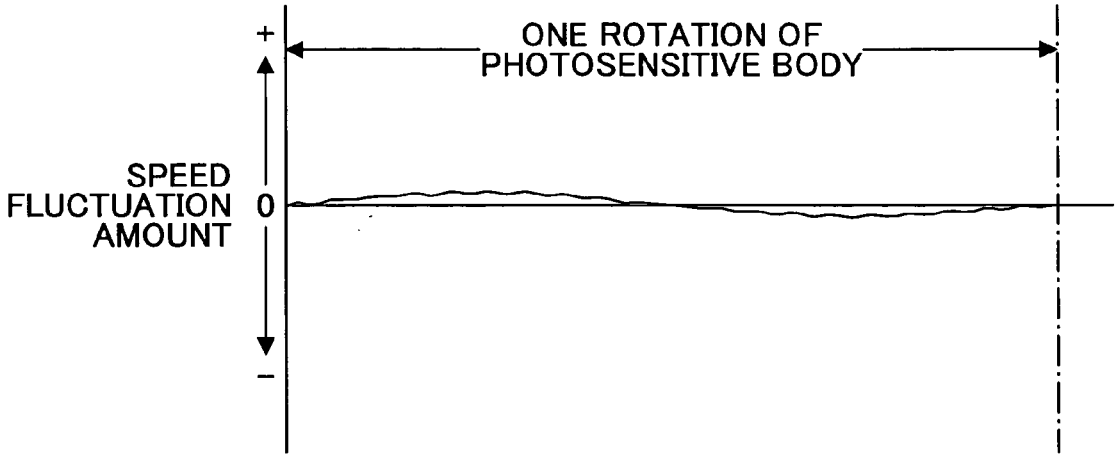
Figure 9:
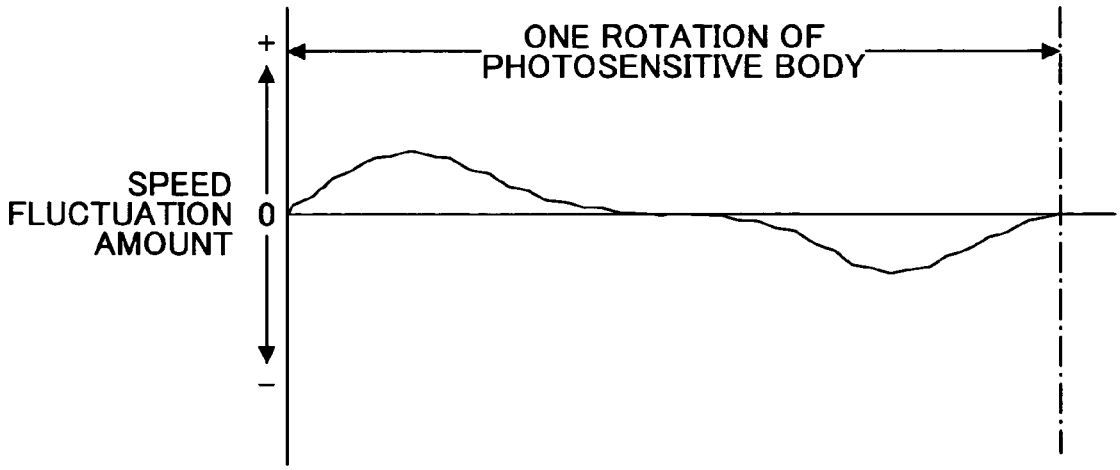
FIG. 9 is a graph showing the remaining speed fluctuation after many outputs are produced in a successive print job.

For example, at the time right after the successive printing operation is started, the remaining speed fluctuation can be made extremely small as shown in FIG. 8 even in the feed-forward control using the speed control pattern constructed in advance when the power is turned on. As is clear from comparison with FIG. 6, minutely saw-toothed crests occurring at high frequencies can be significantly reduced because the speed control pattern is constructed so as to correspond to the high-order speed fluctuation. If the speed fluctuation pattern of the photosensitive body 4K gradually changes from a status when the power is turned on along with the continuation of the successive printing operation, the speed control pattern constructed in advance becomes unsuitable. As shown in FIG. 9, the amplitude of the remaining speed fluctuation then becomes greater than that when the printing operation is started. It should be noted here that the amplitude of the low-order fluctuation component wave in the graph of the remaining speed fluctuation shown in FIG. 9 is greater than that shown in FIG. 8, but the crests (minutely saw-toothed parts) of the high-order fluctuation component wave is same as that shown in FIG. 8. This indicates that even if the successive printing operation is performed, the high-order fluctuation component in the remaining speed fluctuation can be adequately handled by the speed fluctuation pattern constructed when the power is turned on.

Note that the reason why only the first-order and second-order speed fluctuation components among those of the photosensitive body change with the elapse of the time of the successive printing operation is regarded as follows. In other words, it is regarded as one reason that the rotational orbit of the photosensitive body is slightly changed as the contact pressure of the cleaning blade 16 onto the front surface of the photosensitive body changes with the elapse of the time of the successive printing operation. In addition, it is regarded as another reason that when application irregularity of a lubricant to the front surface of the photosensitive body by the fur brush 17 occurs in the same distribution for a long period, the speed fluctuation of the photosensitive body is gradually changed in accordance with the application irregularity.

Figure 10:
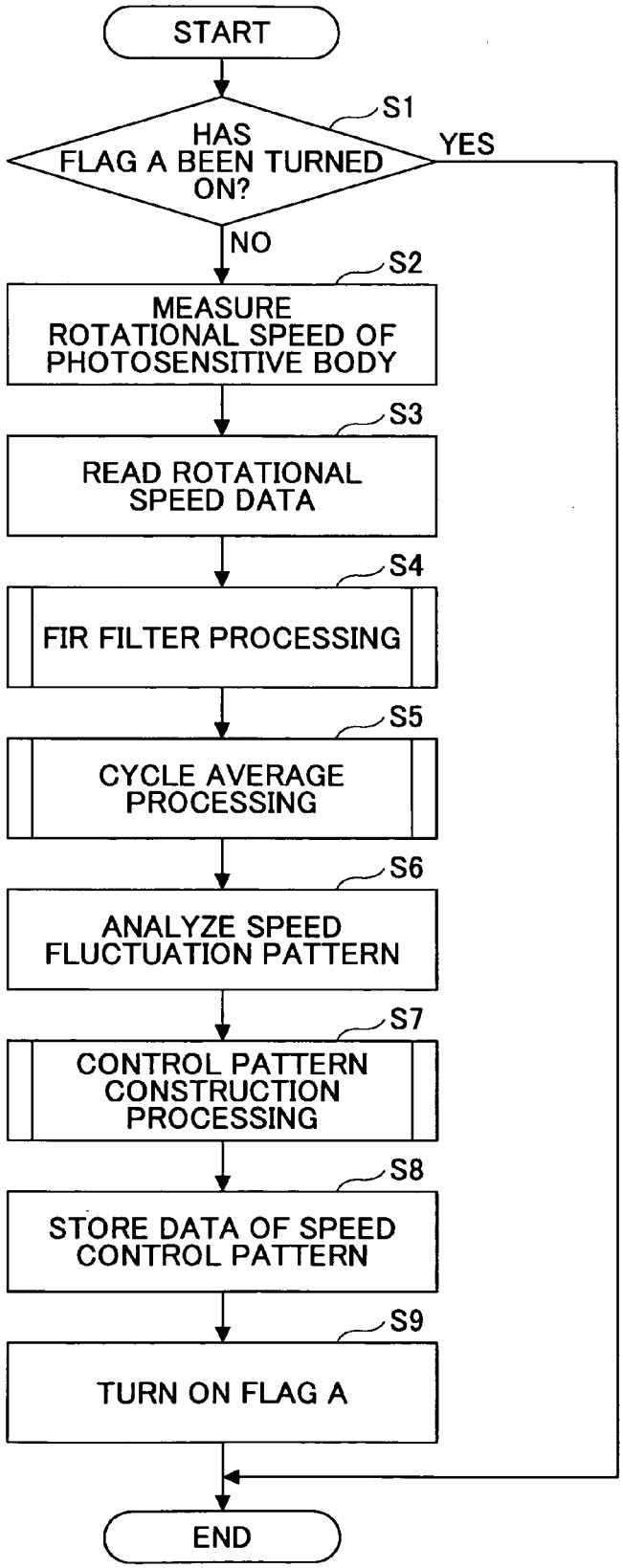
FIG. 10 is a flowchart showing a processing routine performed by a power-on processing routine performed by the control unit.

FIG. 10 is a flowchart showing a processing routine performed by the control unit when the power is turned on (hereinafter referred to as a power-on processing routine). When the power, not shown, of the copier is turned on, the control unit first performs the power-on processing routine and then accepts printing instructions from the user. In this routine, the control unit first determines whether a flag A has been turned on (step 1: hereinafter a step is referred to as "S"). The flag A is immediately turned off when the power is turned off. Furthermore, the flag A is turned on when the power-on processing routine is performed. Therefore, when the flag A is turned on in S1 (Yes in S1), it is determined that the power-on processing routine has been performed after the power was turned on. In this case, a series of control flows are stopped immediately. Conversely, when the flag A is not turned on in S1 (No in S1), the series of control flows are performed continuously. Then, the driving motor for each color is driven at a constant speed to measure the rotational speed of the photosensitive body (S2). Specifically, the CPU 101 issues instructions for driving the driving motor at a constant speed for a predetermined time to the motor controller (e.g., 50K for black) for each color. At the same time, the CPU 101 also issues instructions for calculating the rotational speed of the photosensitive body at a predetermined cycle and successively storing the calculated result to the rotational speed detection circuit (e.g., 46K for black) for each color. It is desired that the power-on processing routine be performed in as short period as possible. Therefore, rotational speed data for three rotations of the photosensitive body are sampled for each color. However, there is also a method for sampling the rotational speed data without the driving of the driving motor at a constant speed. That is, the driving motor is first driven according to a predetermined control pattern. Then, a speed fluctuation amount due to the predetermined control pattern of the driving motor is subtracted from calculated and stored rotational speed data per rotation of the photosensitive body. Thus, it is possible to obtain data similar to that obtained when the driving motor is driven at a constant speed.

After the rotational speed data of the photosensitive body for each color is thus measured, the CPU 101 performs steps S3 through S8 for each color. Specifically, the CPU 101 reads the rotational speed data from the rotational speed detection circuit (S3), applies FIR filter (Finite Impulse Response Filter) processing to the read data (S4), and stores the result in the RAM 102. The FIR filter processing is processing for eliminating ultra-high frequency fluctuation components contained in the rotational speed data. Thus, the 50th-order or higher fluctuation components per rotation of the photosensitive body are eliminated. IIR filter (Infinite Impulse Response Filter) processing may be applied instead of the FIR filter processing. However, the FIR filter processing is superior to the IIR filter processing in that it has a linear phase characteristic and hardly generates waveform deformation. With the filter processing having the linear phase characteristic such as the FIR filter processing, it is possible to correct a phase delay caused when calculation is performed by simple shift processing (e.g., a storage address number or read timing is shifted).

Figure 11:
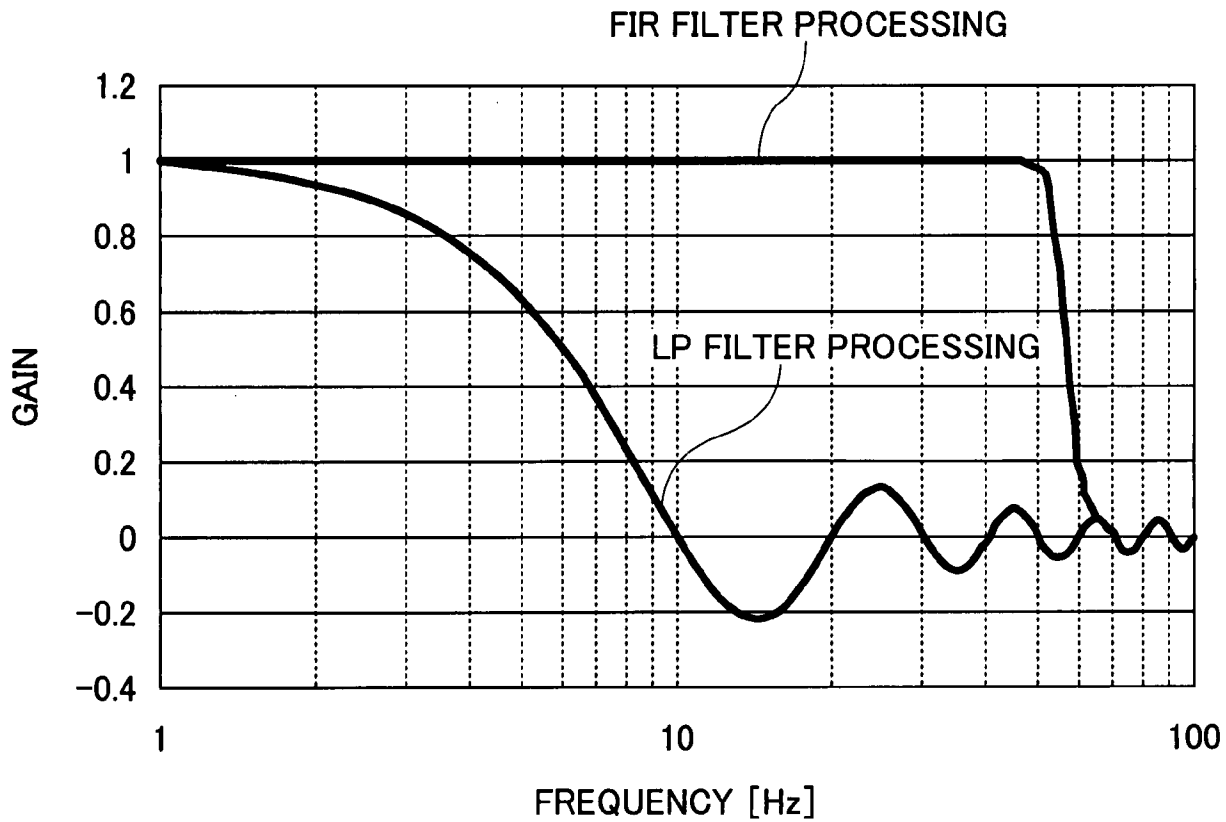
FIG. 11 is a graph showing the frequency characteristic of filter processing.

FIG. 11 is a graph showing the frequency characteristic of the filter processing performed by the control unit 100 of the copier according to the embodiment. In the graph, Gain in a vertical axis indicates the extent to which the amplitude of a detected speed fluctuation component is caused to pass through. At the frequency where Gain is 1, the speed fluctuation component having the same amplitude is output to the next step. Furthermore, at the frequency where Gain is 0, the speed fluctuation component is completely filtered out. In the copier according to the embodiment, the rotational frequency of the photosensitive body is 1.5 Hz and that of the driving motor is 30 Hz. Therefore, as shown in FIG. 11, as the FIR filter processing performed in the power-on processing routine, the control unit 100 allows the speed fluctuation components at frequencies up to 50 Hz to pass through with an amplitude of 100%. Noise components at an ultra-high frequency exceeding 70 Hz are completely filtered out. In this example, the 50th-order FIR filter processing is employed that detects fluctuation components at frequencies up to 70 Hz. When such a FIR filter processing is performed, a phase delay corresponding to 25 data is caused during the calculation processing. Therefore, in order to store the data to which the FIR filter processing has been applied, the memory address of the data is shifted. Thus, phase correction is performed.

After the completion of the FIR filter processing, cycle average processing is applied to the data stored in the RAM 102 (S5). With this cycle average processing, the speed fluctuation components at frequencies that are not synchronized with one cycle of the photosensitive body among those that have passed through the FIR filter are reduced. In the power-on processing routine, only the minimum members are driven unlike a case in which the print job is performed. Therefore, only relatively small noise components are detected. However, there are some noise components including those extemporaneously causing on an irregular basis. Accordingly, the photosensitive body is rotated for three through five times rather than once, and speeds at some points per rotation are averaged.

After the completion of the cycle average processing, the speed fluctuation pattern per rotation of the photosensitive body is analyzed based on each average speed data at each point per rotation of the photosensitive body (S6). Specifically, a predetermined target speed is subtracted from the average speed data at each point per rotation to calculate the speed fluctuation amount at each point. The arrangement of the data of the speed fluctuation amount at each point for one rotation represents the data of the speed fluctuation pattern. Note that the target speed becomes different depending on output modes (such as color, monochrome, priority on quality, and priority on speed).

The above steps from S2 through S6 represent fluctuation pattern recognition processing according to the embodiment of the present invention. Specifically, in this processing, the speed fluctuation of the photosensitive body is detected based on an output from the rotational speed detection circuit serving as the rotation detection unit, while the driving motor serving as a driving source is driven at a constant speed without execution of the print job based on instructions from the user. Thus, the speed fluctuation pattern per integer number of rotation (one rotation) of the photosensitive body is recognized.

After the analysis of the speed fluctuation pattern, the speed control pattern is constructed based on the analyzed speed fluctuation pattern (S7). Specifically, the inversion pattern obtained by inverting the waveform of the speed fluctuation pattern is generated. This inversion pattern can completely cancel the waveform of the speed fluctuation pattern because it is overlapped with the speed fluctuation pattern. That is, the waveform of the speed fluctuation pattern can be converted into a straight line extending in a horizontal direction. After the generation of the inversion pattern, motor control values corresponding to values at points of the waveform of the inversion pattern (hereinafter referred to as inverted values) are calculated. As the driving motor, it is assumed that a 1-2 phase excitation stepping motor is used that rotates by 360° when a motor clock is input to the motor driving circuit 51K (e.g., 51K for black) by an amount of 400 pulses. Furthermore, it is assumed that a reduction ratio from the driving motor to the photosensitive body is set to 1/20. In this case, when the motor clock is input to the driving motor by an amount of 8000 pulses, the photosensitive body rotates by 360°. The data of the 8000 pulses are calculated based on the inverted values and used as the motor control values. These 8000 motor control values are the data of the speed control pattern. The processing performed in S7 is control pattern construction processing for constructing the speed control pattern of the driving motor that reduces the cyclic speed fluctuation of the photosensitive body based on the speed fluctuation pattern.

After the completion of the control pattern construction processing, the 8000 motor control values are stored in the RAM 102 (S8). The RAM 102 has two regions for storing the data of the speed control pattern composed of the 8000 motor control values, and the 8000 motor control values are stored in one of the two regions. Finally, the flag A is turned on to complete the series of control flows.

Figure 12:
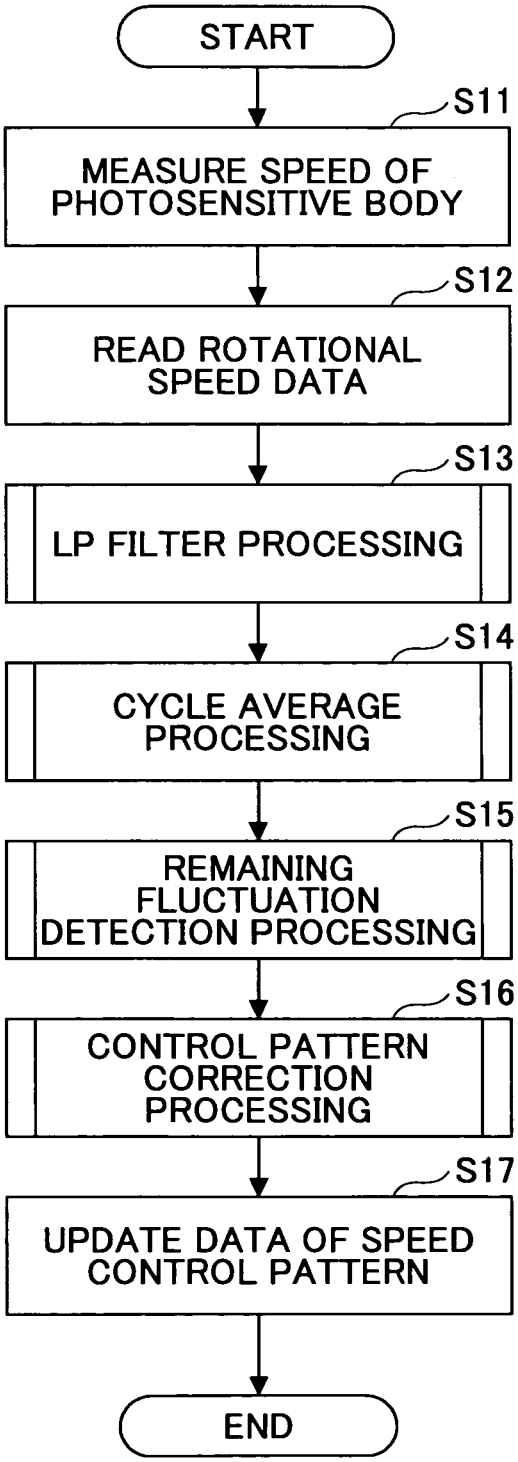
FIG. 12 is a flowchart showing the control flow of a control pattern correction routine performed by a control unit.

FIG. 12 is a flowchart showing the control flow of a control pattern correction routine performed by the control unit. This control pattern correction routine is started at predetermined timing during the print job. In the control pattern correction routine, the CPU 101 issues driving instructions to the motor controller (e.g., 50K for black) for each color based on the data of the speed control pattern stored in the RAM 102. At the same time, the CPU 101 also issues instructions for calculating the rotational speed of the photosensitive body at a predetermined cycle and successively storing the result to the rotational speed detection circuit for each color. Thus, the speed of the photosensitive body is measured in a state in which the driving speed of the driving motor is finely adjusted based on the data of the speed control pattern for each color (only black in monochrome mode) (S11). Then, the rotational speed data are successively read from the rotational speed detection circuit (S12) and stored in the RAM 102 while being subjected to LP (Low Pass) filter processing (S13). Unlike the FIR filter processing in the power-on processing routine, this LP filter processing allows only low-order fluctuation components to pass through. Specifically, as shown in FIG. 11, the LP filter processing hardly allows fluctuation components in bands exceeding 10 Hz to pass through. On the other hand, a fluctuation component at 1.5 Hz as one rotation cycle of the photosensitive body, i.e., as large as 95% of the first-order fluctuation component per rotation of the photosensitive body is allowed to pass through. In addition, as large as 80% of the second-order fluctuation component (3 Hz) per rotation of the photosensitive body is allowed to pass through. Unlike the 50th-order FIR filter processing that detects a high-order fluctuation component such as 70 Hz with high accuracy after completely eliminating ultra-high-order fluctuation components, the LP filter processing that detects only low-order fluctuation components can significantly reduce a calculation load. That is, the LP filter processing, which is used for eliminating the ultra-high-order components exceeding the 50th order and allowing the low frequency components to pass through, does not require a steep frequency characteristic like the FIR filter processing in FIG. 11, and it has only a moderate frequency characteristic like the LP filter processing in FIG. 11. Therefore, a calculation load by the filter processing becomes extremely lighter.

After the completion of the LP filter processing, the cycle average processing is applied to the data stored in the RAM 102 (S14). During the print job, many noise components are contained in the speed data. Therefore, speeds at some points of the photosensitive body per rotation of the photosensitive body are averaged by rotations larger in number than those of the cycle average processing in the power-on processing routine. For example, the speeds of about 10 rotations of the photosensitive drum are averaged.

After the completion of the cycle average processing, remaining fluctuation detection processing is performed (S15). Specifically, the amplitude and phase of the first-order and second-order speed fluctuation components per rotation of the photosensitive body are detected. As a method for detecting them, the amplitude and phase of the fluctuation components are detected from the zero cross or peak value of a fluctuation value using the average of the speed data at all the points as zero. With this method, however, the detected result is significantly influenced by noise. As a result, it causes a large error and is not practical. Therefore, the copier of the embodiment employs a method for calculating from the speed data the amplitude and phase of the fluctuation component occurring at the rotation cycle of the photosensitive body with data processing (orthogonal detection processing) using orthogonal detection. The orthogonal detection processing is a known signal analysis technology for a demodulator circuit in the field of communications.

Figure 13:
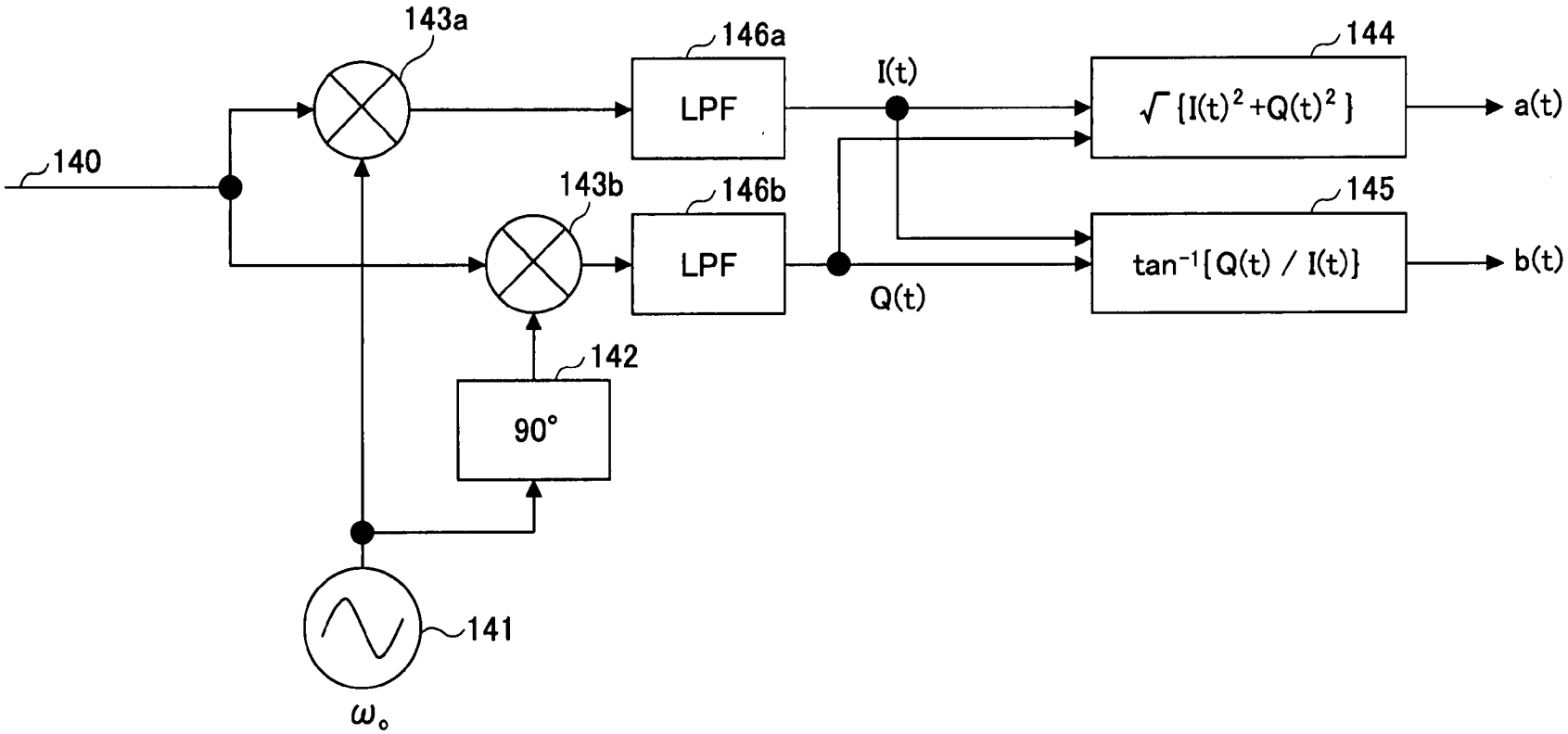
FIG. 13 is a block diagram showing the content of orthogonal detection processing.

FIG. 13 is a block diagram showing the content of the orthogonal detection processing. The copier of the embodiment uses the speed data at each point as an input signal 140. An oscillator 141 outputs a signal at a frequency component to be detected (here, at the frequency of the rotational cycle of the photosensitive body) to a first multiplier 143*a* and a 90° phase shifter 142. A first multiplier 143*a* multiplies the input signal 140 by the signal at the oscillation frequency output from the oscillator 141, and a second multiplier 143*b* multiplies the input signal 140 by a signal output from the 90° phase shifter 142. The input signal 140 is separated into the signal of the in-phase component (I-component) and that of the orthogonal component (Q-component) of the photosensitive body by the first and second multipliers 143*a* and 143*b*; an output from the first multiplier 143*a* is the I-component and that from the second multiplier 143*b* is the Q-component. A first LPF 146*a* allows only the signal in a low frequency band among those multiplied by the first multiplier 143*a* to pass through. The copier of the embodiment uses a low pass filter that smoothes data for the integral multiple cycle of an oscillation cycle, i.e., speed data for one rotation of the photosensitive body. The same applies to a second LPF 146*b*. An amplitude calculation unit 144 calculates an amplitude a(t) corresponding to the two inputs (the I-component and Q-component). Furthermore, a phase calculation unit 145 calculates a phase b(t) corresponding to the two inputs. These amplitude a(t) and phase b(t) are the amplitude of the cycle fluctuation component of the photosensitive body and a phase angle from any reference timing, respectively. Note that when the amplitude and phase of the second-order fluctuation component relative to one rotation of the photosensitive body and the fluctuation component of a driving motor rotation cycle are detected, the oscillation cycle may be set to the second-order component and motor rotation cycle to perform the same processing. The amplitude and phase of the fluctuation component of the speed data are thus calculated with the orthogonal detection processing, thereby making it possible to calculate the amplitude and phase with high accuracy compared with the method using the zero cross or peak value of a fluctuation value. As another method for calculating the amplitude and phase of the cycle fluctuation component, Fourier transform analysis (FFT analysis) may be performed to calculate them from a desired frequency component value. However, the orthogonal detection processing generates a significantly smaller calculation load and is more appropriate where it is performed during an image output operation as in the case of the copier of the embodiment.

After the calculation of the amplitude and phase of each cycle component with the orthogonal detection processing, a remaining speed fluctuation value at each point for one rotation of the photosensitive body is calculated. Note that the attenuation (smoothing) and phase delay of each cycle component due to the LP filter processing are calculated from the frequency characteristic of the LP filter processing to correct the attenuation and phase delay of the remaining speed fluctuation value. Thus, a remaining speed fluctuation pattern including the first-order and second-order fluctuation components for one rotation of the photosensitive body is obtained.

After the completion of the remaining fluctuation detection processing, control pattern correction processing is performed (S16). In this control pattern correction processing, the inversion pattern obtained by inverting the waveform of the remaining speed fluctuation pattern is generated. Next, the motor control value corresponding to the inverted value at each point of the waveform of the inversion pattern is calculated. Then, the calculated motor control value at each point is added to a motor control value at each point of the speed fluctuation pattern that has been used so far, thereby correcting the speed fluctuation pattern.

After the completion of the control pattern correction processing, the data of the speed control pattern are updated (S17). Specifically, as described above, the ROM 102 has the two regions for storing the data of the speed control pattern composed of the 8000 motor control values for each color. Immediately after the power is turned on to perform the power-on processing routine, the data of an initial speed control pattern are stored in one of the two regions (hereinafter referred to as a first region) for each color. When the control pattern correction routine in FIG. 12 is first performed after the power-on processing routine, the driving motor for each color is driven based on the initial speed control pattern. Next, the data of the corrected speed control pattern are stored in the other region (hereinafter referred to as a second region). Then, at the time at which driving control using the initial speed control pattern for one cycle is completed, the data of the speed control pattern used for finely adjusting the driving speed of the driving motor are changed from the initial data to the data newly stored in the second region. After that, in the next control pattern correction routine, while the driving motor is driven in accordance with the new speed control pattern stored in the second region, the corrected speed control pattern is overwritten in the first region. At the time at which the driving control using the initial speed control pattern for one cycle is completed, the speed control pattern to be used is switched from the speed control pattern stored in the second region to that stored in the first region.

The control pattern correction routine shown in FIG. 12 may be performed for each rotation of the photosensitive body during the print job. In this case, however, the correction of the speed control pattern may cause a greater speed fluctuation in some rotation. Specifically, since the remaining speed fluctuation gradually increases along with an increase in the number of print-out sheets during the print job, the remaining speed fluctuation does not rapidly increase between two mutually successive rotations of the photosensitive body. For this reason, there are not so many benefits in updating the speed control pattern for each rotation. Meanwhile, in case that the remaining speed fluctuation rapidly increases due to an unexpected factor caused, for example, when an impact is applied to the photosensitive body by the operation of the user in a rotation, the speed control in the next rotation is based on the detected result. Therefore, the remaining fluctuation in the next rotation is rather increased. Conversely, when the control pattern correction routine is performed with an appropriate time interval, the speed control pattern can be corrected based on the result obtained by averaging the remaining fluctuations of the appropriate number of rotations (such as 10 rotations). Accordingly, even if the speed fluctuation due to an unexpected factor is detected in a rotation, the speed control pattern can be properly corrected so as to have almost no influence by the speed fluctuation.

The control unit of the copier of the embodiment determines timing for performing the next control pattern correction processing when an elapsed time after the control pattern correction processing exceeds a predetermined time (e.g., five minutes). Thus, during the successive printing operation, the control pattern correction processing is performed every time the predetermined time elapses. Furthermore, when the print job is started after the reception of printing instructions is waited for a relatively long period in a state in which the print job is stopped, the control pattern correction processing is performed immediately after the print job is started.

As described above, in FIG. 4, the rotational speed detection circuit 46K constituting a part of the control unit determines reference timing in each rotation of the photosensitive body 4K based on an output from the rotary encoder 43K serving as the rotation detection unit and then outputs a timing signal to the CPU 101. Specifically, the number of pulses output from the rotary encoder 43K during a period in which the photosensitive body 4K rotates by 360° is the same for each rotation. That is, when the number of pulses output from the rotary encoder 43K becomes a predetermined number, the photosensitive body 4K just rotates by 360°. The rotational speed detection circuit 46K detects as reference timing the time at which it receives an initial pulse from the rotary encoder 43K when the driving of the photosensitive body is started. Then, the rotational speed detection circuit 46K detects as the reference timing the time at which it receives the initial pulse every time the photosensitive body 4K rotates by 360° and outputs the timing signal to the CPU 101 at each reference timing. The CPU 101 specifies the reading motor control value of the speed control pattern at each point in each rotation based on the timing signal output from the rotational speed detection circuit 46K and the waveform of the remaining speed fluctuation pattern analyzed by the CPU 101 itself. With this configuration, the reading motor control value of the speed control pattern at each point in each rotation can be specified without the provision of a reference timing detection unit that detects timing at which the photosensitive body 4K has a predetermined rotational angle as the reference timing.

Next, modifications of the copier according to the embodiment are described. Note that the configuration of the copier according to the modifications is the same as that of the embodiment unless otherwise specified.

(First Modification)

In the copier according to a first modification, a reference timing detection unit that detects, as reference timing, timing at which the photosensitive body has a predetermined rotational angle in each rotation is provided in each of the photosensitive bodies 4K, 4Y, 4C, and 4M for black, yellow, cyan, and magenta. As such a reference timing detection unit, a rotary encoder may be exemplified that detects a code wheel every time the code wheel rotates by a predetermined rotational angle and outputs a timing signal. Also, a sensor may be used that detects a mark provided at a predetermined position of the photosensitive gear 42K at a predetermined rotational position. The CPU 101 specifies, for each color, the reading motor control value of the speed control pattern at each point in each rotation of the photosensitive body based on the output from the reference timing detection unit.

With this configuration, the copier can specify the reading motor control value of the speed control pattern at each point in each rotation of the photosensitive body without performing counting processing in which the number of pulses from the rotary encoder is counted.

(Second Modification)

The control unit of the copier according to a second modification determines timing for performing the next control pattern correction processing when the number of print-out sheets after the control pattern correction processing has reached (or it has exceeded) a predetermined number. With this configuration, an appropriate time interval can be provided between the previous control pattern correction processing and the next control pattern correction processing based on the number of print-out sheets.

(Third Modification)

The control unit of the copier according to a third modification determines timing for performing the next control pattern correction processing when an environmental fluctuation amount after the control pattern correction processing has reached a predetermined amount. As the environmental fluctuation amount, an interior temperature fluctuation amount based on a temperature detection result by an interior temperature sensor is used. With this configuration, an appropriate time interval can be provided between the previous control pattern correction processing and the next control pattern correction processing based on the interior temperature fluctuation amount.

(Fourth Modification)

The control unit of the copier according to a fourth modification determines timing for performing the next control pattern correction processing when the amplitude of the remaining speed fluctuation pattern has reached a predetermined value. With this configuration, an appropriate time interval can be provided between the previous control pattern correction processing and the next control pattern correction processing based on the amplitude of the remaining speed fluctuation pattern.

The above description refers to the copier in which respective-color toner images formed on the photosensitive bodies for the respective colors are transferred to the intermediate transfer belt so as to be superimposed one on another. However, the embodiment of the present invention can also be applied to an image forming apparatus in which respective-color toner images are transferred to a recording medium held on the front surface of a surface moving body such as a belt member so as to be superimposed one on another.

As described above, according to the embodiment of the present invention, the remaining speed fluctuation pattern remaining in the image carrier is recognized by the remaining pattern recognition processing during the print job in which the transfer process is performed. The speed control pattern is corrected based on the recognized result to update the speed control pattern on a regular basis. Thus, the image forming apparatus can prevent the degradation of a color shift due to an unsuitable speed control pattern without increasing the downtime of the apparatus.

Furthermore, the image forming apparatus can reduce a calculation load on the control unit that performs the remaining pattern recognition processing during the print job for the reason described below. That is, the present inventors have found from an experiment how the speed fluctuation pattern (hereinafter referred to as an initial fluctuation pattern) when the power is turned on changes in accordance with the successive printing operation. Specifically, the present inventors have found that the low-order fluctuation components such as the first-order and second-order fluctuation components among those at various cycles included in the initial fluctuation pattern greatly change when the power is turned on, but the high-order fluctuation components hardly change. That is, among a wide frequency band including high and low orders, only fluctuation components in a particular narrow frequency band mainly change. Thus, the speed fluctuation is detected in the wide frequency band including the high and low orders at particular timing such as time when the power is turned on. With this configuration, the change of the speed fluctuation only in a particular narrow frequency band is recognized, thereby making it possible to appropriately update the speed control pattern. Therefore, according to the embodiment of the present invention, the control pattern construction processing is performed to recognize the speed fluctuation pattern of the image carrier in a state in which the print job based on instructions from the user is not performed. At this time, since the print job is not performed, a heavy calculation load is not applied to the control unit even if the speed fluctuation is detected in the wide frequency band including the low and high orders. When the remaining speed fluctuation is detected during the print job, a frequency band to be detected is made narrower than that at the control pattern construction processing so as to target a band such as a low-order band where a change is particularly easily made. Thus, the image forming apparatus can reduce the calculation load on the control unit.

Accordingly, the image forming apparatus according to the embodiment of the present invention can prevent the degradation of a color shift due to an inappropriate speed control pattern and reduce an arithmetic load on a control unit without increasing the downtime of the apparatus.

The present invention is not limited to the specifically disclosed embodiments, and variations and modifications may be made without departing from the scope of the present invention.

The present application is based on Japanese Priority Application No. 2008-171030 filed on Jun. 30, 2008, the entire contents of which are hereby incorporated herein by reference.

What is claimed is:

1. An image forming apparatus comprising:

an image carrier that has a visible image carried on a rotating peripheral surface thereof;

a driving source that generates a driving force for rotating and driving the image carrier;

a rotation detection unit that detects a rotational angle speed or a rotational angle displacement of the image carrier; and a control unit that performs fluctuation pattern recognition processing for detecting a speed fluctuation of the image carrier based on an output from the rotation detection unit while driving the driving source in a state in which a print job in accordance with a user's instruction is not performed, thereby recognizing a speed fluctuation pattern per integer rotation of the image carrier, control pattern construction processing for constructing a speed control pattern of the driving source that reduces a cyclic speed fluctuation of the image carrier based on the speed fluctuation pattern, speed fine-adjustment processing for finely adjusting a driving speed of the driving source in accordance with the speed control pattern during a transfer process including at least a process for transferring the visible image on the peripheral surface of the image carrier to a transfer body or a process for transferring a visible image on another image carrier to the peripheral surface of the image carrier, and remaining pattern recognition processing for detecting a remaining speed fluctuation remaining in the image carrier even after the speed fine-adjustment processing is performed, thereby recognizing a remaining speed fluctuation pattern per integer rotation of the image carrier; wherein the control unit is configured to perform control pattern correction processing for setting a frequency band of the remaining speed fluctuation to be detected by the remaining pattern recognition processing narrower than a frequency band of the speed fluctuation to be detected by the fluctuation pattern recognition processing and correcting the speed control pattern so as to be a pattern capable of reducing even the remaining speed fluctuation based on the remaining speed fluctuation pattern recognized by the remaining pattern recognition processing.

2. The image forming apparatus according to claim 1, wherein the control unit is further configured so that reference timing in each rotation of the image carrier is recognized in each rotation of the image carrier based on the output from the rotation detection unit and the driving speed of the driving source is finely-adjusted based on a recognized result in the speed fine-adjustment processing.

3. The image forming apparatus according to claim 1, further comprising:

a reference timing detection unit that detects timing at which the image carrier has a predetermined rotational angle in each rotation as reference timing; wherein the control unit is further configured so that the driving speed of the driving source is finely-adjusted based on an output from the reference timing detection unit in the speed fine-adjustment processing.

4. The image forming apparatus according to claim 1, wherein the control unit is further configured so that a first-order remaining speed fluctuation and a second-order remaining speed fluctuation per rotation of the image carrier are detected in the remaining pattern recognition processing.

5. The image forming apparatus according to claim 1, wherein the control unit is further configured so that timing for performing the next control pattern correction processing is determined based on an elapsed time after the control pattern correction processing is performed.

6. The image forming apparatus according to claim 1, wherein the control unit is further configured so that timing for performing the next control pattern correction processing is determined based on the number of print-out sheets after the control pattern correction processing is performed.

7. The image forming apparatus according to claim 1, wherein the control unit is further configured so that timing for performing the next control pattern correction processing is determined based on an environmental fluctuation amount after the control pattern correction processing is performed.

8. The image forming apparatus according to claim 1, wherein the control unit is further configured so that timing for performing the next control pattern correction processing is determined based on an amplitude of the remaining speed fluctuation pattern.

* * * * *